US008855535B2

(12) United States Patent
Takahashi

(10) Patent No.: US 8,855,535 B2
(45) Date of Patent: Oct. 7, 2014

(54) TONER SUPPLY DEVICE AND IMAGE FORMING APPARATUS

(75) Inventor: Yasufumi Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 257 days.

(21) Appl. No.: 13/291,497

(22) Filed: Nov. 8, 2011

(65) Prior Publication Data

US 2012/0148312 A1 Jun. 14, 2012

(30) Foreign Application Priority Data

Dec. 13, 2010 (JP) ..... 2010-277358

(51) Int. Cl.
*G03G 15/08* (2006.01)

(52) U.S. Cl.
CPC ..... *G03G 15/0872* (2013.01)
USPC ..... 399/258

(58) Field of Classification Search
USPC ..... 399/107, 110–114, 119, 120, 252, 399/258–263
See application file for complete search history.

(56) References Cited

U.S. PATENT DOCUMENTS

| | | | | |
|---|---|---|---|---|
| 7,391,998 | B2 * | 6/2008 | Aoki et al. | 399/254 |
| 7,512,373 | B2 * | 3/2009 | Shimizu | 399/358 |
| 7,787,784 | B2 * | 8/2010 | Hori | 399/27 |
| 7,962,071 | B2 | 6/2011 | Tsuda et al. | |
| 8,036,575 | B2 * | 10/2011 | Tsuda | 399/254 |
| 2006/0222414 | A1 | 10/2006 | Yamamura | |
| 2009/0226221 | A1 | 9/2009 | Takahashi | |
| 2009/0257785 | A1 | 10/2009 | Okuda et al. | |
| 2010/0003055 | A1 | 1/2010 | Kikuchi et al. | |
| 2011/0020017 | A1 | 1/2011 | Takahashi | |
| 2011/0058858 | A1 | 3/2011 | Fukuda et al. | |

FOREIGN PATENT DOCUMENTS

| | | | |
|---|---|---|---|
| CN | 101556452 | A | 10/2009 |
| JP | 2006-276615 | A | 10/2006 |
| JP | 4006215 | | 8/2007 |
| JP | 2008-46233 | | 2/2008 |
| JP | 2009-258163 | A | 11/2009 |
| JP | 2009-258514 | A | 11/2009 |
| JP | 2010-2625 | A | 1/2010 |
| JP | 2010-32988 | | 2/2010 |

OTHER PUBLICATIONS

Combined Office Action & Search Report issued Mar. 22, 2013 in Chinese Application No. 201110403909.8 (With English Translation).
Office Action issued Apr. 18, 2014, in Japanese Patent Application No. 2010-277358.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A toner supply device includes a toner storage section including plural toner containing sections and a dividing part, the plural toner containing sections being arranged from an upstream side to a downstream side in a toner feeding direction and including respective rotating members configured to rotate to feed the toner, the dividing part being formed between the toner containing sections adjacent to each other and including an upper end part. Further, a position of the upper end part of the dividing part is higher than a position of a rotational center of the rotating member included in the toner containing section on the upstream side in the toner feeding direction of the toner containing sections adjacent to each other.

14 Claims, 16 Drawing Sheets

FIG.16

| X | MAXMUM VALUE | MINIMUM VALUE | AVERAGE VALUE | STANDARD DEVIATION |
|---|---|---|---|---|
| 12.0 | 0.43 | 0.28 | 0.372 | 0.0439 |
| 13.0 | 0.45 | 0.32 | 0.388 | 0.0328 |
| 13.5 | 0.44 | 0.36 | 0.402 | 0.0224 |
| 14.0 | 0.43 | 0.38 | 0.418 | 0.0199 |
| 14.5 | 0.44 | 0.38 | 0.424 | 0.0192 |
| 15.0 | 0.45 | 0.39 | 0.422 | 0.0189 |

TONER SUPPLY DEVICE AND IMAGE FORMING APPARATUS

CROSS-REFERENCE TO RELATED APPLICATIONS

The present application claims priority under 35 U.S.C §119 based on Japanese Patent Application No. 2010-277358 filed Dec. 13, 2010, the entire contents of which are hereby incorporated herein by reference.

BACKGROUND OF THE INVENTION

1. Field of the Invention

The present invention generally relates to a toner supply device to be used in an image forming apparatus such as a copier, a printer, a facsimile machine, a multi-functional peripheral and the like, and an image forming apparatus including the toner supply device.

2. Description of the Related Art

There have been known various image forming apparatuses including a toner supply device that supplies toner to a development device, the toner contained in an exchangeable toner container, the development device visualizing a latent image to be a toner image, the latent image formed on a surface of a photosensitive drum or the like serving as a latent image carrier.

Among these, there has been known an image forming apparatus including a toner supply device supplying toner to the development device based on the toner consumption in the development device which may be known as a two-component development device using developer including toner and carrier.

Further, as an exchangeable toner container for containing toner, toner cartridges having various shapes are known. For example, some toner cartridges includes a toner bottle having a cylindrical shape. Further, in most of the image forming apparatuses having an exchangeable toner container, to supply the toner to the development device, a feeding screw provided in the cartridge or free fall due to gravity is typically used.

Recently, some image forming apparatuses include a toner storage unit (hereinafter referred to as a "sub-hopper") inside the main body of the image forming apparatuses, so that toner is supplied from the toner cartridge to the sub-hopper and then the toner is further supplied from the sub-hopper to the development device. For example, Japanese Patent No. 4006215 (Patent Document 1) discloses a configuration including plural toner containing sections in the sub-hopper.

By having this configuration, toner is supplied from the toner cartridge to the sub-hopper and further supplied to the development device via plural toner containing sections of the sub-hopper, using feeding screws serving as feeding members and provided in the respective toner containing sections.

Further, the sub-hopper described in Patent Document 1 includes upper and lower parts. Further, the upper part of the sub-hopper includes two toner containing sections arranged side by side having respective feeding screws in a manner such that the heights of the rotational axes are substantially the same as each other.

On the other hand, the lower part of the sub-hopper includes one toner containing section. Between the two toner containing sections of the upper part of the sub-hopper, there is a dividing plate having openings on the respective ends portions of the dividing plate. By the dividing plate, the two toner containing sections are divided as two sections, which are a toner containing section on the upstream side in a toner feeding direction (hereinafter "upstream-side toner containing section") and a toner containing section on the downstream side in the toner feeding direction (hereinafter "downstream-side toner containing section").

An inlet port to receive toner is formed on the upper part on the upstream side of the upstream-side toner containing section. On the other hand, a communication port through which the toner drops to one end part of the toner containing part of the lower part of the sub-hopper (hereinafter "lower toner containing section") is formed on the downstream side of the downstream-side toner containing section.

By having the configuration described above, toner is supplied from the toner cartridge to the upstream-side toner containing section, and screws are rotatably driven so that toner that cannot be dropped to the lower toner containing section can circulate between the upstream-side toner containing section and the downstream-side toner containing section.

Further, toner having been dropped through the communication port of the lower toner containing section to the one end part of the lower toner containing section is fed to the other end part of the lower toner containing section by a rotatably-driven feeding screw. The toner is further fed to the development device via a discharge port formed on the lower end part in the downstream side of the "lower toner containing section.

As described above, by having the sub-hopper in the main body of the image forming apparatus, it becomes possible to continue printing using toner in the sub-hopper for a certain time period even when there is no toner remaining in the toner cartridge that is to be exchanged by the user. Namely, even when there is no toner remaining in the toner cartridge and it is required to exchange the toner cartridge, it is possible to delay the exchange of the ink cartridge until the image forming apparatus is not used, which may make great contribution to the reduction of the down time of the image forming apparatus.

Further, it may become possible to make it easier to reduce the size of the image forming apparatus because the structural limitation in the positional relationship between the toner cartridge and the development device due to no sub-hopper is alleviated. Further, when compared with the configuration where ink is directly supplied from the ink cartridge to the development device, it may also make it easier to more accurately supply ink in the configuration in which the sub-hopper is provided in the main body of the image forming apparatus.

Further, in the configuration of Patent Document 1, toner is directly fed from the sub-hopper to the development device through the discharge port formed of the lower toner containing section. However, there has been another method to feed toner from the sub-hopper to the development device. For example, unlike the method in Patent Document 1, there is also a known method in which a feeding member such as a spiral screw or coil is provided in a tube-like feeding path so as to feed toner by the rotation of the spiral screw or the coil.

In the mean time, demands for reducing the size and the cost of the image forming apparatus are getting more and more stronger. However, it may be difficult to meet the demands when the sub-hopper include the upper and the lower parts as described above.

SUMMARY OF THE INVENTION

According to an aspect of the present invention, a toner supply device includes a toner storage section temporarily storing toner supplied from a toner container and supply the toner to a development device visualizing a latent image as a toner image, the latent image being formed on a latent image carrier.

Further the toner storage section includes plural toner containing sections arranged from an upstream side to a downstream side in a toner feeding direction and including respective rotating members rotating to feed the toner.

Further, a position of a rotational center of the rotating member included in the toner containing section on the downstream side in the toner feeding direction is higher than a position of the rotational center of the rotating member included in the toner containing section on the upstream side in the toner feeding direction.

Further, the rotating member of the toner containing section other than the toner containing section disposed on a downstreammost side in the toner feeding direction includes a plate-like elastic member rotating to feed the toner to an adjoining toner containing section disposed on the downstream side in the toner feeding direction.

Further, the toner storage section further includes a dividing part formed between the toner containing sections adjacent to each other and including an upper end part and side wall surfaces extended from arc-shaped bottom parts of the respective toner containing sections adjacent to each other so as to form an opening above the dividing part so that the toner can cross over the dividing part and feed from one of the toner containing sections to another via the opening.

Further, a position of the upper end part of the dividing part is higher than the position of the rotational center of the rotating member included in the toner containing section on the upstream side in the toner feeding direction of the toner containing sections adjacent to each other.

Further, the toner supplied to the toner containing section disposed on an upstreammost side in the toner feeding direction is sequentially fed to the toner containing section on the downstream side in the toner feeding direction by a rotation of the rotating member including the plate-like elastic member.

BRIEF DESCRIPTION OF THE DRAWINGS

Other objects, features, and advantages of the present invention will become more apparent from the following description when read in conjunction with the accompanying drawings, in which:

FIG. 16 is a table illustrating variation of a toner supply amount relative to the foot length of the paddle of the sub-hopper.

DETAILED DESCRIPTION OF THE PREFERRED EMBODIMENTS

Recently, there have been strong demands for reducing the size and the cost of the image forming apparatus. However, it may be difficult to further reduce the size when a sub-hopper in a toner supply device has a configuration in which the sub-hopper includes upper and lower parts as described in Patent Document 1.

Figure 9:
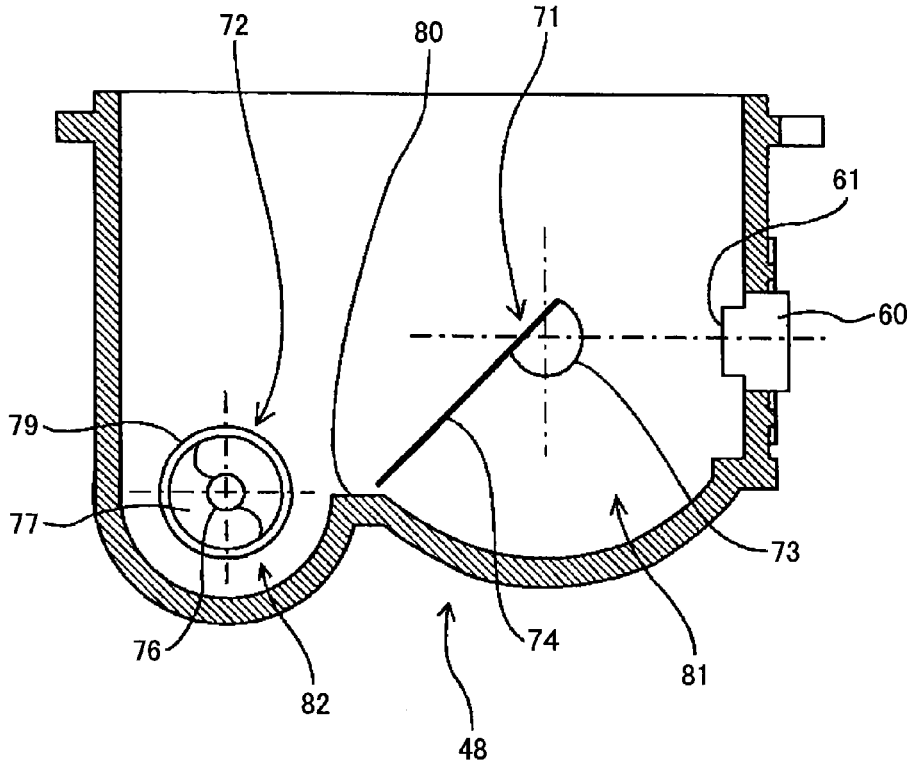
FIG. 9 is a cross-sectional view of a sub-hopper in a comparative example.

In order to meet the strong demands, namely in order to further reduce the size of the ink supplying device (i.e., the image forming apparatus), the inventor of the present invention has studied the sub-hopper having a configuration as illustrated in FIG. 9.

In FIG. 9, a sub-hopper 48 includes a first toner containing section 81, a second toner containing section 82, and a dividing part 80. The first toner containing section 81 has a bottom part having an arc-shaped inner surface and is provided for at least receiving toner.

The second toner containing section 82 also has the bottom part having the arc-shaped inner surface and is provided for at least discharging toner through a toner discharger port 79. Further, the dividing part 80 is formed between the first toner containing section 81 and the second toner containing section 82 in a manner such that the toner in the first toner containing section 81 may be in communication with toner in the second toner containing section 82 through above the dividing part 80.

Further, in the first toner containing section 81, there is provided a first rotating member 71 for feeding the toner having been received into the first toner containing section 81 to the second toner containing section 82.

On the other hand, in the second toner containing section 82, there is provided a second rotating member 72 for feeding the toner in the second toner containing section 82 to the toner discharger port 79 through which the second toner containing section 82 is in communication with a tube-like feeding path.

In this case, the rotational center of the first rotating member 71 in the first toner containing section 81 is substantially in parallel to the rotational center of the second rotating member 72 in the second toner containing section 82.

Further, the height (i.e., in the vertical direction in FIG. 9) of the rotational center of the second rotating member 72 in the second toner containing section 82 is substantially equal to the height of the dividing part 80 dividing between the bottom part of the first toner containing section 81 and the bottom part of the second toner containing section 82.

Further, the height of the rotational center of the second rotating member 72 in the second toner containing section 82 is lower than the height of the rotational center of the first rotating member 71 in the first toner containing section 81.

Further, unlike Patent Document 1, the configuration of the sub-hopper 48 in FIG. 9 does not include the upper and the lower parts of the sub-hopper. Therefore, it may make it easier to further reduce the size and the cost when compared with the configuration having the sub-hopper as in Patent Document 1.

Further, in a case where the toner supply method is used based on the conventional configuration or the configuration as illustrated in FIG. 9, when toner contains a large amount of air and has flowability (fluid nature), the toner which is practically (mostly) powders may have similar behavior as that of fluid.

In such a case, in the conventional configuration an in the configuration as illustrated in FIG. 9, even when the operations of the feeding members are stopped, the toner may flow into the toner containing sections and the tube-like feeding path.

This may occur because, in the conventional configuration or the configuration as illustrated in FIG. 9, there is no means that may prevent such a movement of toner toward the downstream side, such as a dividing part (plate) provided in the toner containing sections and the tube-like feeding path, or the height of the dividing part is not high enough.

Therefore, the toner disposed on the upper side of the inclination of an "Angle of Repose" that corresponds to the flowability of the toner and determined based on the base point of boundary parts of the toner containing sections or the tube-like feed path may cross over the boundary parts and flow into the downstream-side toner containing section or the tube-like feeding path.

Then, the toner disposed on the upper side of the inclination of the "Angle of Repose" determined based on the base point on the downstreammost side toner containing section may flow until the inclination of the toner is equal to or less than the inclination of the "Angle of Repose".

As a result, toner may flow into the tube-like feeding path or the development device from the downstreammost side toner containing section. Further, in the downstreammost side toner containing section in the toner flowing direction disposed at the lowest position among the plural toner containing sections, toner is more likely to be contained so as to cover the feeding member.

In such a case, a larger amount of toner is more likely to flow into the tube-like feeding path or the development device. Therefore, a large amount of toner having higher flowability may flow into the development device. As a result, toner density in the development device may be excessively increased, which may cause the increase of the toner density and toner scattering.

Further, due to the increase of the toner density, it may become difficult to maintain the toner density at a normal level, which may make it difficult to form an image having a normal image density.

Those phenomena may more frequently occur when a new toner cartridge is installed and toner is supplied from the new toner cartridge into an empty sub-hopper (hereinafter the toner flow in this case refers to an "initial flow").

Similarly, those phenomena may more frequently occur when toner is continually supplied from the sub-hopper to the development device during continuous printing images having a higher rate of high-quality image area (hereinafter the toner flow in this case refers to a "continual flow").

In order to reduce the occurrence of the phenomena, there have been proposed various methods. For example, in Japanese Laid-open Patent Publication No. 2010-032988 (Patent Document 2), there is provided a space limiting member to limit the space through which toner passes in the straight section of the tube-like feeding section for feeding toner from the sub-hopper to the development device, a coil serving as a feeding member being provided in the straight section.

By providing the space limiting member as a part of the tube-like space in the feeding path, when compared with a case where the tube-like space of the feeding path is not limited, an air mount in the tube-like space may be reduced so as to reduce the mixture of toner and air in the feeding path so as to prevent the flowability of the toner from being excessively increased.

Therefore, by preventing the flowability of the toner from being excessively increased, the toner in the feeding path may be prevented from being flown into the development at once.

However, it is conceived that the configuration of Patent Document 2 may not effectively work when the flowability of the toner is excessively increased before the toner is fed into the tube-like feeding path. Further, by providing such an additional part like the space limiting member in the tube-like feeding path, the cost may be increased due to the increase of the number of parts and a feed mount of toner from the sub-hopper to the development device per unit time may be decreased.

The present invention is made in light of the problems, and may provide a toner supply device stably supplying toner to the development device by reducing the initial flow and the continual flow and with a simple configuration.

In the following, as an image forming apparatus employing the present invention, a tandem-type color laser printer (hereinafter printer 1000) including plural photosensitive bodies arranged in parallel according to an embodiment of the present invention is described with reference to several examples and figures.

Figure 1:
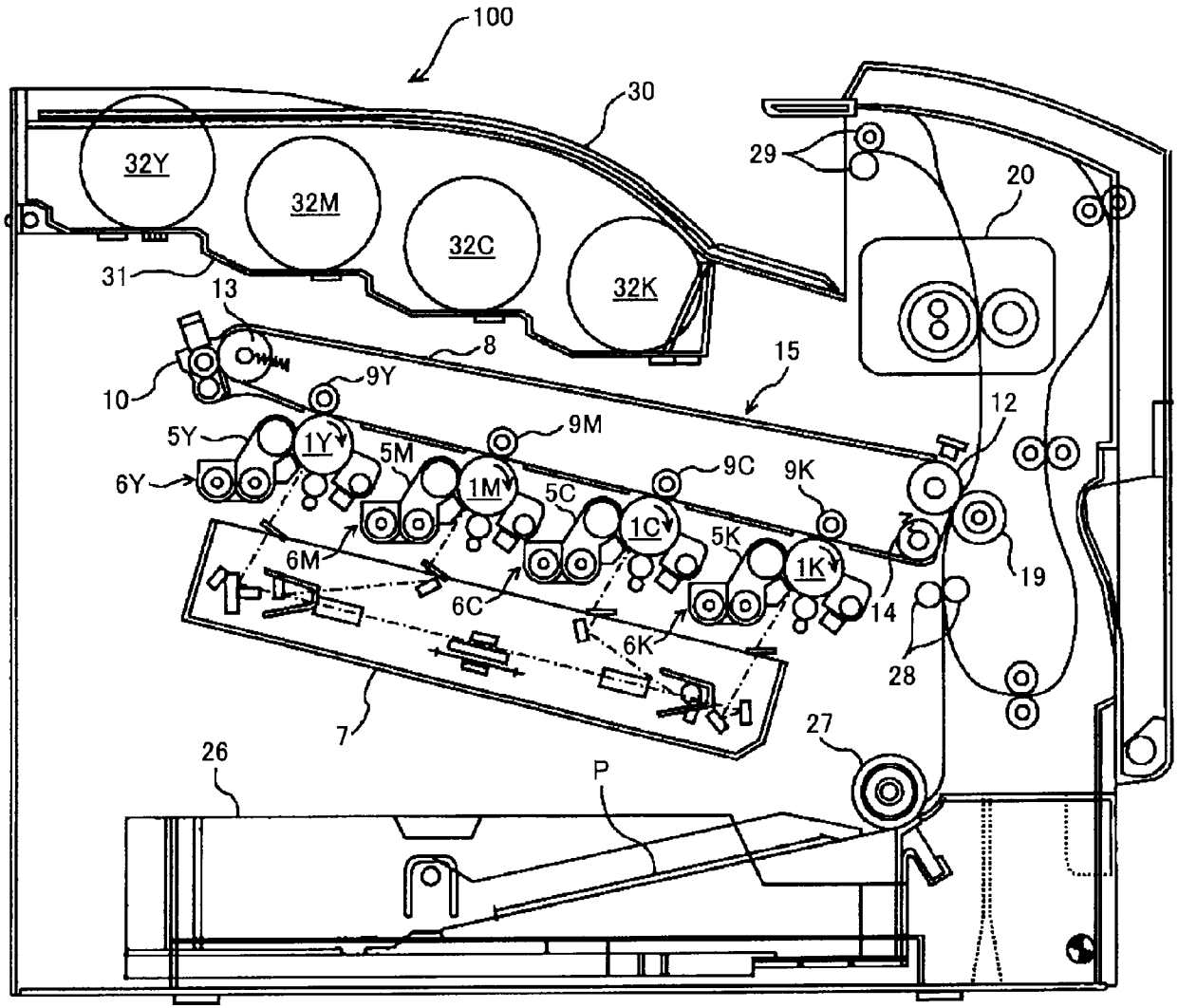
FIG. 1 is a schematic drawing illustrating a printer according to an embodiment of the present invention.
Figure 2:
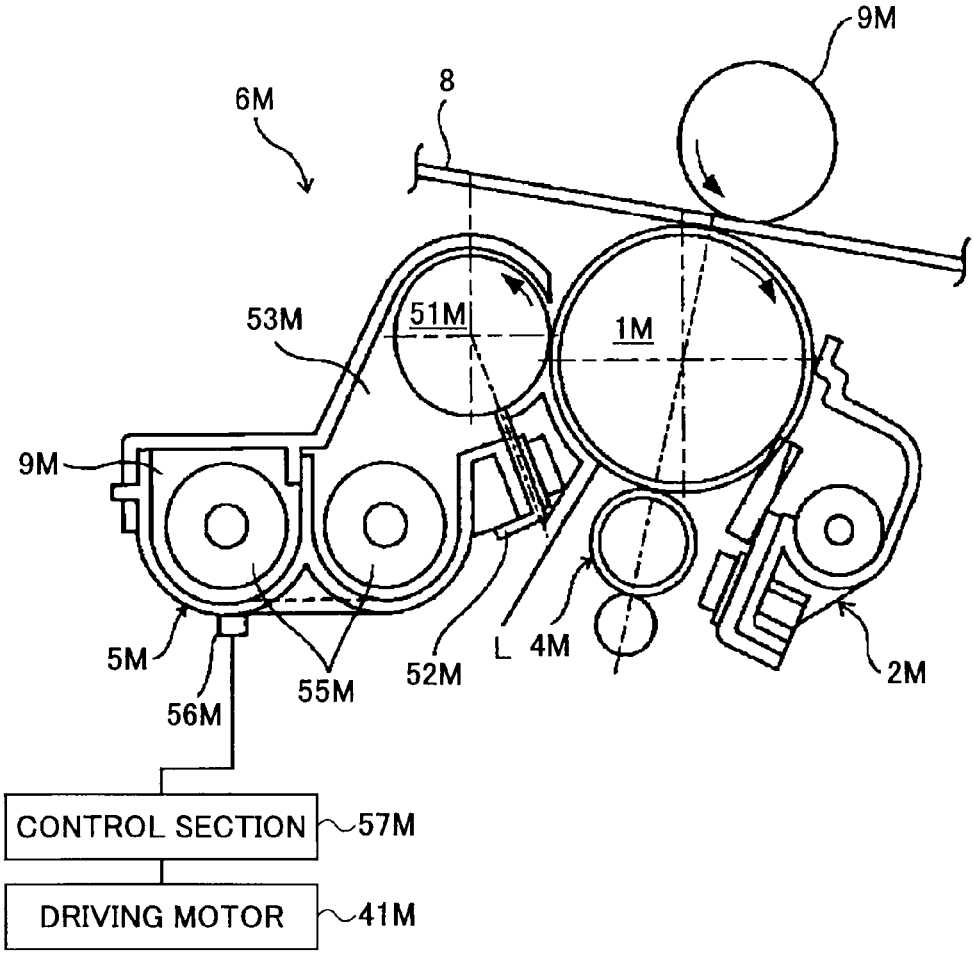
FIG. 2 is an enlarged view of vicinity of a process cartridge.
Figure 3:
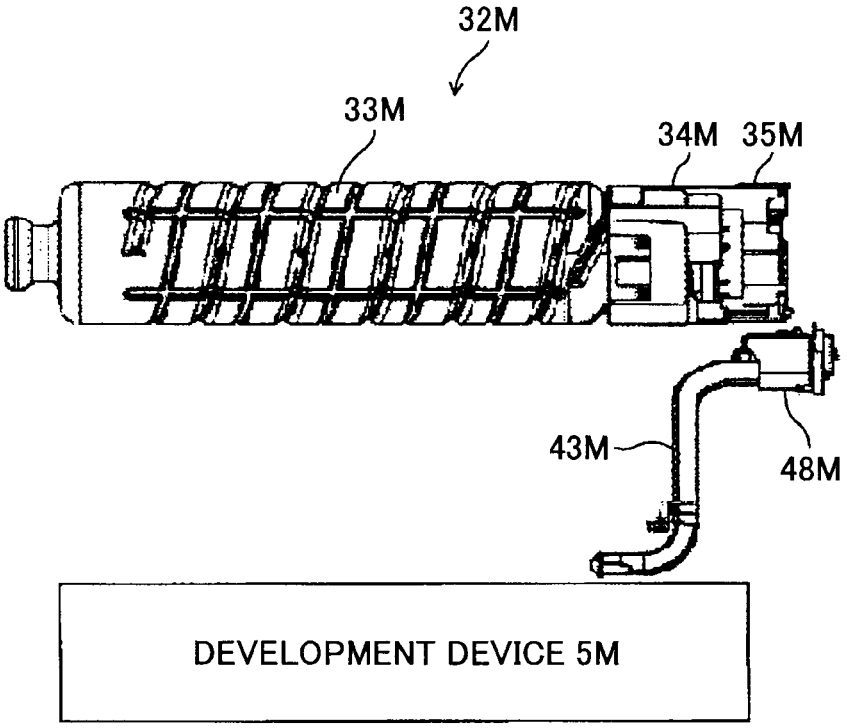
FIG. 3 is a side view of a toner bottle.
Figure 4:
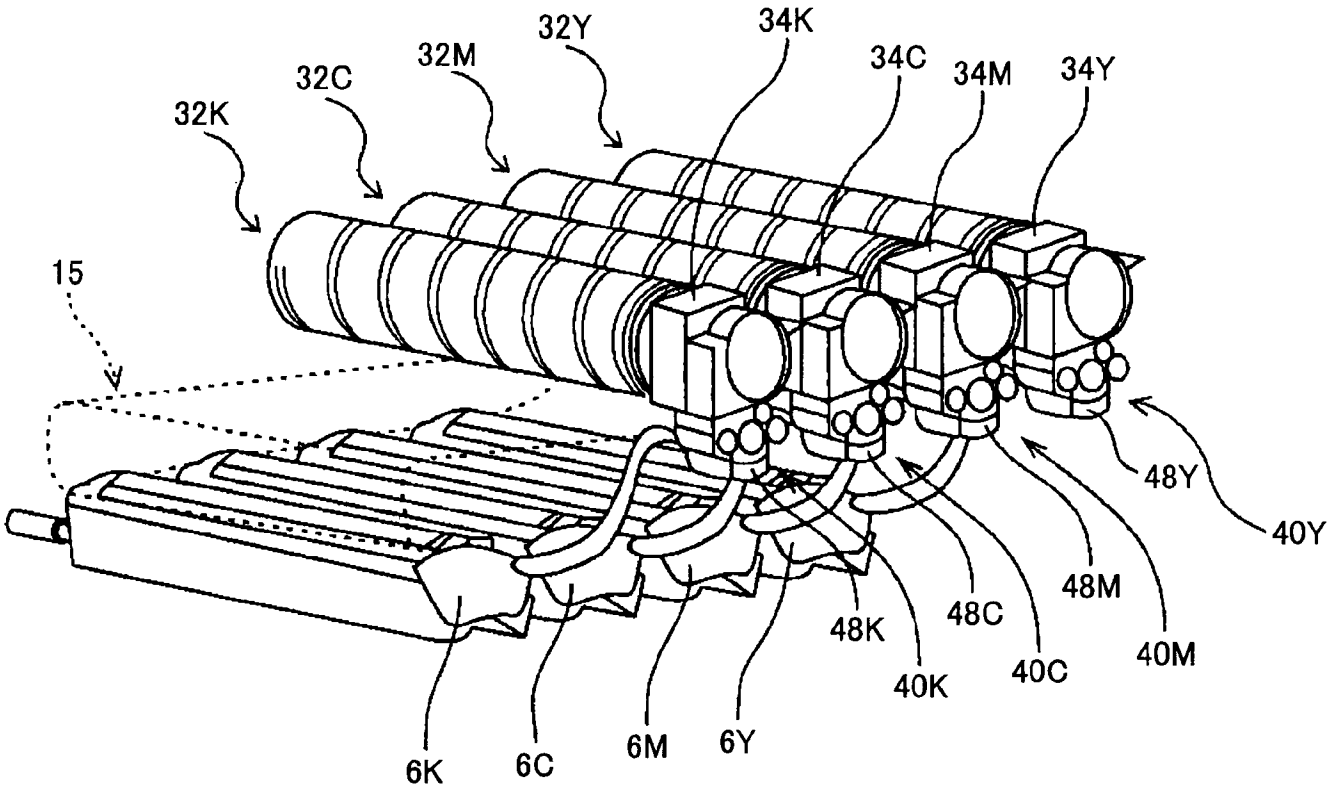
FIG. 4 is a perspective view of the toner bottle, a toner supply device, an intermediate transfer unit, and the process cartridge.
Figure 5:
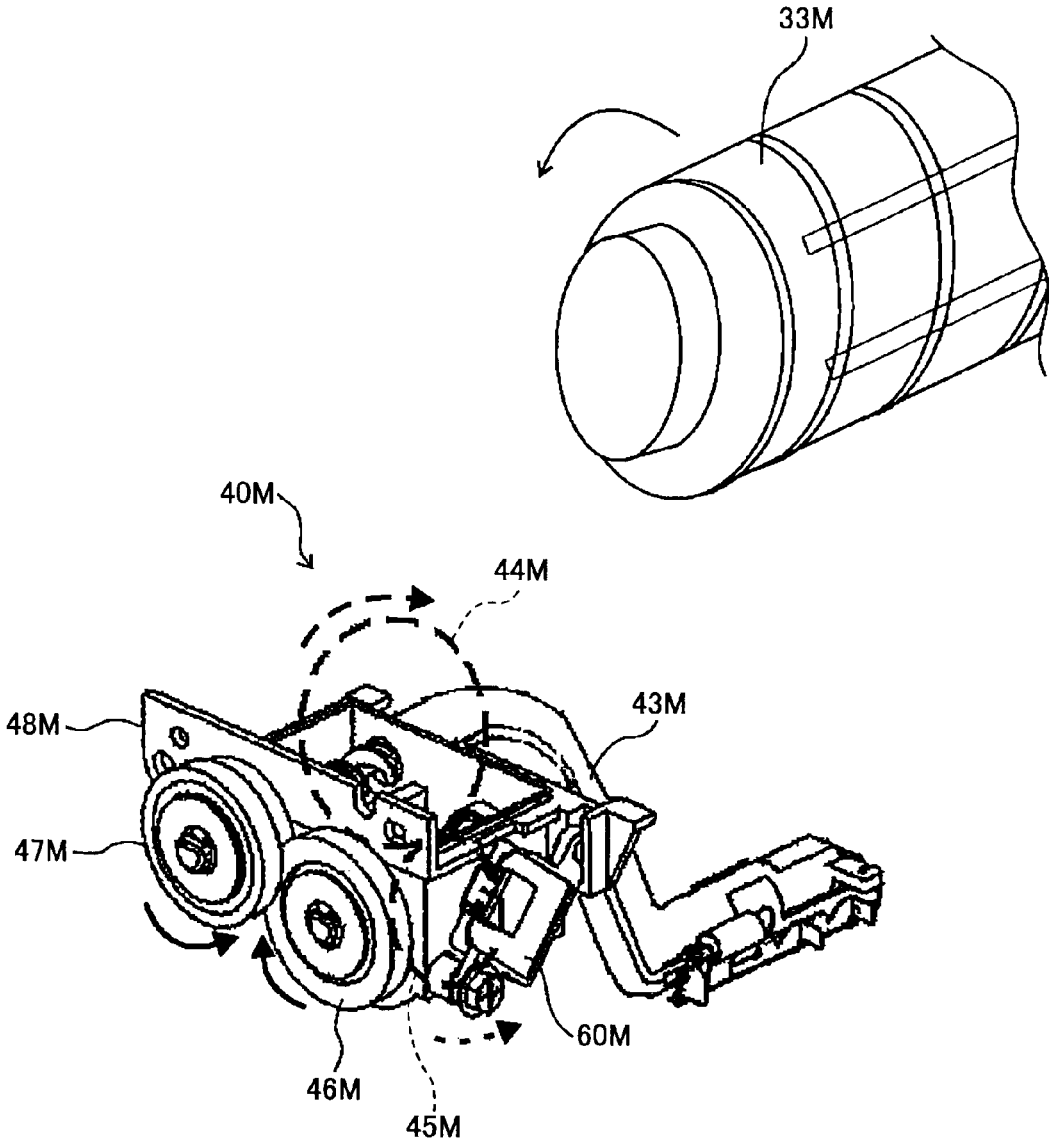
FIG. 5 is a perspective partial view of the toner supply device when viewed from a right-hand side of FIG. 3.
Figure 6:
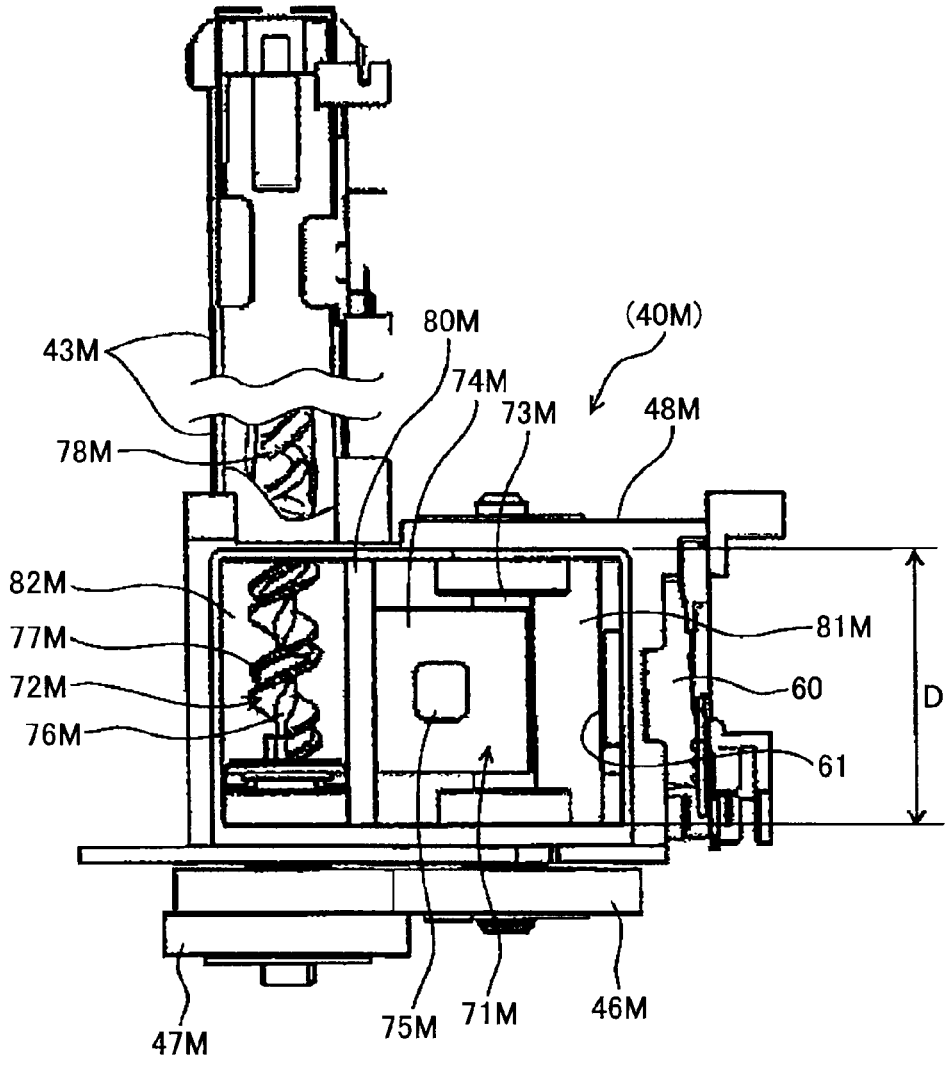
FIG. 6 is a top view of a sub-hopper.

FIG. 1 schematically illustrates the printer 100 according to the embodiment. FIG. 2 is an enlarged view of a vicinity of a process cartridge. FIG. 3 is a side view of a toner bottle. FIG. 4 is a perspective view of the toner bottle, a toner supply device, an intermediate transfer unit, and the process cartridge. FIG. 5 is a perspective partial view of the toner supply device when viewed from a right-hand side of FIG. 3. FIG. 6 is a top view of a sub-hopper. First, outline of the image forming apparatus in this embodiment common to the examples is described.

First, a fundamental configuration of the printer 100 is described. As illustrated in FIG. 1, the printer 100 includes four process cartridges 6Y, 6M, 6C, and 6K for forming yellow (Y), magenta (M), cyan (C), and black (K) toner images, respectively. Those process cartridges 6Y, 6M, 6C, and 6K use different color toner of Y toner, M toner, C toner, and K toner, respectively, as image forming materials. However, other than that, they have the same configuration and is exchanged at the end of the service lifetime.

When the process cartridge 6M for forming an M toner image is exemplarily described, as illustrated in FIG. 2, the process cartridge 6M includes a drum-shaped photosensitive body 1M, a drum cleaning device 2M, a neutralization device (not shown), a charging device 4M, a development device 5M and the like. The process cartridge 6M is detachably provided to the main body of the printer 100, so that the consumables in the process cartridge 6M may be exchanged at a time.

The charging device 4M uniformly charges the surface of the photosensitive body 1M rotating in the clockwise direction in the figure by a driving unit (not shown). This uniformly-discharged surface of the photosensitive body 1M is exposed and scanned so as to carry an M (Magenta) latent image. This M latent image is developed by the development device 5M to form an M (Magenta-colored) toner image. Then, the M toner image is intermediately transferred onto an intermediate transfer belt 8.

The drum cleaning device 2M removes toner remaining on the surface of the photosensitive body 1M after the M toner image is intermediately transferred. The neutralization device neutralizes the surface of the photosensitive body 1M. By the neutralization, the surface of the photosensitive body 1M is initialized and prepared for the next image forming.

In the same manner, in other process cartridges 6Y, 6C, and 6K, Y, C, and K toner images are formed on the photo sensitive bodies 1Y, 1C, and 1K, respectively, and are intermediately transferred onto the intermediate transfer belt 8.

As illustrated in FIG. 1, there is an exposure device 7 disposed below the process cartridges 6Y, 6M, 6C, and 6K. The exposure device 7 serving as a latent image forming unit radiates laser light onto the photosensitive drums of the respective process cartridges 6Y, 6M, 6C, and 6K for exposure. Due to the exposure, the Y, M, C, and K latent images are formed on the photosensitive body 1Y, 1M, 1C, and 1K, respectively. Typically, the exposure device 7 radiates laser light (L) onto the photosensitive drums via plural optical lenses by scanning the laser light (L) using a polygon mirror rotatable driven by a motor.

Further, as illustrated in FIG. 1, on the lower side of the exposure device 7, there are a sheet feeding unit including a sheet containing cassette 26, a sheet feeding roller 27 mounted on the sheet containing cassette 26, and a resist roller pair (a pair of resist rollers) 28. The sheet containing cassette 26 contains plural transfer sheets P serving as recording medium, so that the top of the transfer sheets P is in contact with the sheet feeding roller 27.

When the sheet feeding roller 27 is rotatably drive by a driving unit (not shown) to rotate in the counterclockwise direction of the figure, the top transfer sheet P is fed toward between the pair of the resist rollers 28. The pair of the resist rollers 28 rotates so as to hold (sandwich) the fed transfer sheet P. The pair of the resist rollers 28 temporarily stop rotating right after holding the transfer sheet P.

Then, the pair of the resist rollers 28 resume to rotate to further fed the transfer sheet P to a secondary transfer nip section described below at an appropriate timing. In the sheet feeding unit having the configuration described above, a feeding unit includes the sheet feeding roller 27 and the resist roller pair 28 serving as a timing roller pair.

This feeding unit feeds the transfer sheet P from the sheet containing cassette 26 serving as a containing unit for containing the transfer sheets P to the secondary transfer nip section described below.

In FIG. 1, on the upper side of the process cartridges 6Y, 6M, 6C, and 6K, there is an intermediate transfer unit 15 that stretches and endlessly moves the intermediate transfer belt 8 serving as an intermediate transfer body. The intermediate transfer unit 15 includes the intermediate transfer belt 8, primary transfer bias rollers 9Y, 9M, 9C, and 9K, a cleaning device 10, a secondary transfer backup roller 12, a cleaning backup roller 13, and a tension roller 14.

The intermediate transfer belt 8 is stretched by those three rollers and endlessly moved (rotated) in the counterclockwise direction of the figure by the rotation of at least one of the three rollers. The primary transfer bias rollers 9Y, 9M, 9C, and 9K are provided so that the primary transfer bias rollers 9Y, 9M, 9C, and 9K and the photosensitive body 1Y, 1M, 1C, and 1K sandwich the intermediate transfer belt 8 to form respective primary transfer nip sections.

In this method, a transfer bias having a polarity (e.g., plus polarity) opposite to the polarity of the toner is applied to the rear surface (i.e., inner peripheral surface) of the intermediate transfer belt 8. All the rollers except the primary transfer bias rollers 9Y, 9M, 9C, and 9K are electrically grounded.

In the endless movement of the intermediate transfer belt 8, the intermediate transfer belt 8 sequentially passes through Y, M, C, and K primary transfer nip sections. In the Y, M, C, and K primary transfer nip sections, the Y, M, C, and K toner images are primary transferred and superimposed, so that the toner image having superimposed four colors (hereinafter referred to as a "four-color toner image") is formed on the intermediate transfer belt 8.

The secondary transfer backup roller 12 is provided so that the secondary transfer backup roller 12 and a secondary transfer roller 19 sandwich the intermediate transfer belt 8 to form the secondary transfer nip section.

The four-color toner image having been formed on the intermediate transfer belt 8 is transformed onto the transfer sheet P in this secondary transfer nip section. On the intermediate transfer belt 8 having passed through the secondary transfer nip section, there may be toner that has not been transferred onto the transfer sheet P. The toner remaining on the intermediate transfer belt 8 is removed by the cleaning device 10.

In the secondary transfer nip section, the transfer sheet P is sandwiched between the intermediate transfer belt 8 and the secondary transfer roller 19 which have the respective surfaces moving in the direction same as the feeding direction of the transfer sheet P, and fed toward the side opposite to the side of the resist roller pair 28. The transfer sheet P fed from the secondary transfer nip section passes between the rollers in a fixing device 20.

In the section between the rollers in the fixing device 20, the four-color toner image having been transformed on the surface of the transfer sheet P is fixed due to heat and pressure applied by the rollers in the fixing device 20. After that, the transfer sheet P is discharged outside via the section between a pair of discharge rollers 29. On the upper surface of the printer 100, a stack section 30 is formed, so that the transfer sheets P discharged via the pair of discharge rollers 29 are sequentially stacked on the stack section 30.

Basically, the configuration of the process cartridges 6Y, 6M, 6C, and 6K are substantially the same as each other except the (color of the) toner to be used. Therefore, the development device 5M in the process cartridge 6M is exemplarily described. The development device 5M includes a magnetic field generation unit inside the development device 5M. The development device 5M includes a development sleeve 51M, a doctor 52M, a development sleeve containing section 53M, and a developer containing section 54M.

The development sleeve 51M serves as a developer carrier that carries two-component developer including magnetic particles and toner on the surface of the development sleeve 51M. The doctor 52M serves as a developer limiting member that adjusts (limits) the layer thickness of the developer carried on the surface of the development sleeve 51M. The development sleeve containing section 53M provides a space to contain the development sleeve 51M.

The developer containing section 54M is provided adjacent to the development sleeve containing section 53M and provides a space to contain the developer. In the development sleeve containing section 53M and the developer containing section 54M, respective developer feeding screws 55M for agitating and feeding the developer are provided. The development device 5M further includes a density detection sensor 56M serving as a toner density sensor detecting the toner density of developer in the developer containing section 54M.

Based on the detection result by the density detection sensor 56M, toner is supplied into the developer containing section 54M. To that end, a toner supply port (not shown) is formed on the developer containing section 54M.

Next, operations of the development device 5M are described. The developer is agitated and fed based on the rotation of the developer feeding screws 55M, so as to circulate in the developer containing section 54M and in the development sleeve containing section 53M. Due to being agitated and fed, frictional charge is generated between the toner of the developer and carriers, so that the toner of the developer is electrically charged.

The developer including the charged toner in the development sleeve containing section 53M is attracted to the surface of the development sleeve 51M having a magnetic pole inside the development sleeve 51M, so that the developer is carried on the development sleeve 51M by the magnetic force of the magnetic pole. The developer (developer layer) carried on the development sleeve 51M is fed in the arrow direction of FIG. 2 as the development sleeve 51M rotates.

During being fed, the layer thickness of the developer layer carried on the development sleeve 51M is adjusted (limited) by the doctor 52M. After that, the developer layer having adjusted thickness is fed to the development section where the development sleeve 51M (i.e. the developer layer on the development sleeve 51M) faces the photosensitive body 1M.

In the development section, the latent image formed on the photosensitive body 1M is developed. After passing through the development section, the developer layer remaining on the development sleeve 51M is further fed as the development sleeve 51M rotates, and is separated from the development sleeve 51M by the opposite magnetic force by the magnetic pole inside the development sleeve 51M.

Then the separated developer is contained along with the developer which is agitated and fed in the part where the developer feeding screw 55M is provided on the lower part of the development sleeve containing section 53M.

As illustrated in FIG. 1, there is a toner bottle base 31 is provided between the intermediate transfer unit 15 and the stack section 30 disposed above the intermediate transfer unit 15.

The toner bottle base 31 contains toner bottles 32Y, 32M, 32C, and 32K which are the toner cartridges containing Y, M, C, and K toner, respectively. The toner bottles 32Y, 32M, 32C, and 32K are disposed on the intermediate transfer unit 15. The Y, M, C, and K toner of the toner bottles 32Y, 32M, 32C, and 32K is supplied to the development devices 5Y, 5M, 5C, and 5K of the process cartridges 6Y, 6M, 6C, and 6K by the respective toner supply devices described below.

In dependent from the process cartridges 6Y, 6M, 6C, and 6K, those toner bottles 32Y, 32M, 32C, and 32K are detachably mounted on the main body of the printer 100.

As illustrated in FIG. 3, for example, in a toner bottle 32M, a resin case 34M are provided at the header portion of a bottle main body 33M. Further, a handle 35M is integrally formed with the resin case 34M. Further, on the resin case 34M side of the bottle main body 33M, a bottle rotation gear (not shown) integrally rotating with the bottle main body 33M is provided.

When the toner bottle 32M is mounted on the main body of the printer 100, first, the stack section 30 is open upward to expose the toner bottle base 31. Then, the toner bottle 32M is placed on the toner bottle base 31, and the handle 35M is rotated in the depth direction of the figure.

As the handle 35M rotates, a shutter (not shown) provided on the lower part of the resin case 34M is opened and a toner drop port (not shown) is opened and the resin case 34M is connected and fixed to the toner bottle base 31. On the other hand, when the toner bottle 32M is separated from the main body of the printer 100, by rotating the handle 35M in the opposite direction, the connection between the resin case 34M and toner bottle base 31 is released, and the shutter and the toner drop port are closed.

Under this state, by using the handle 35M, the toner bottle 32M can be detached from the inside of the main body of the printer 100. As described above, the toner bottle 32M can be mounted on and detached from the main body of the printer 100 while being placed on the printer 100, it may be easy to exchange the toner bottle 32M. Further, due to the handle 35M provided on the resin case 34M, it may be easy to fix the toner bottle 32M to the toner bottle base 31.

Further, while the toner bottle 32M is separated from the main body of the printer 100, the shutter is configured so as not to be open even when the handle 35M on the resin case 34M is rotated. By having this configuration, during the operation to exchange the toner bottle 32M, even when the shutter is accidentally open, the leakage of the toner in the toner bottle 32M may be prevented.

Next, a toner feeding unit is described. As illustrated in FIG. 4, toner supply devices 40Y, 40M, 40C, and 40K are disposed above the intermediate transfer unit 15, at the back side of FIG. 1, and inside of the main body of the printer 100. Due to the positions of the toner supply devices 40Y, 40M, 40C, and 40K, it may not be necessary to further provide the respective toner feeding units in the process cartridges 6Y, 6M, 6C, and 6K or the toner bottles 32Y, 32M, 32C, and 32K.

As a result, it may become possible to reduce the size of the process cartridges and the toner bottles when compared with conventional process cartridges and the toner bottles. Further, in a conventional printer, there may be restriction that the process cartridges and the toner bottles have to be closely disposed to each other.

On the other hand, in the printer 100, the process cartridges and the toner bottles may be more separated from each other. Therefore, the degree of freedom of design may be improved and the size of the printer 1000 may be reduced.

Further, it may become possible to dispose the toner drop ports of the toner bottles 32Y, 32M, 32C, and 32K, the toner supply devices 40Y, 40M, 40C, and 40K, and the toner supply ports of the developer containing sections 54Y, 54M, 54C, and 54K of the development devices 5Y, 5M, 5C, and 5K at the same end side of the intermediate transfer unit 15.

As a result, it may become possible to reduce the length of the toner feeding path of the toner supply devices 40Y, 40M, 40C, and 40K and also reduce the size of the printer and the risk of the clogging of the toner during the toner feeding.

Basically, the configuration of the toner supply devices 40Y, 40M, 40C, and 40K are substantially the same as each other. Therefore, the toner supply devices 40M is exemplarily described with reference to FIGS. 5 and 6. As illustrated in FIGS. 5 and 6, the toner supply devices 40M mainly includes the sub-hopper 48 serving as a toner containing section, a toner feeding pipe 43M serving as a toner feeding path having a toner supply feeding member, and a driving motor M (not shown).

Further, the resin case 34M is provided on the toner bottle 32M side. The resin case 34M includes plural drive transmission gears to rotate the bottle main body 33M, so that toner can be supplied from the toner bottle 32M to the sub-hopper 48.

In the sub-hopper 48, a first toner containing section 81M and a second toner containing section 82M are provided. The first toner containing section 81M is disposed under the toner drop port of the toner bottle 32M.

Further the bottom part of the first toner containing section 81M and the bottom part of the second toner containing section 82M are divided by a dividing part 80M. Further, in the first toner containing section 81M, there is a first rotating member 71M having a paddle 74M as a plate-like elastic member and having a first rotational axis 73M.

The first rotating member 71M is equipped with a first gear 46M outside the case of the sub-hopper 48. On the other hand, in the second toner containing section 82M, there is a second rotating member 72M having a spiral screw 77M to be rotated around a second rotational axis 76M.

The second rotating member 72M is equipped with a second gear 47M outside the case of the sub-hopper 48. Further, the driving motor M is connected to a supply drive transmission gear 45M illustrated in a dotted circle in FIG. 5.

When the driving motor M is driven, the supply drive transmission gear 45M rotates in the counterclockwise direction and the first gear (agitation-side gear) 46M in engagement with the supply drive transmission gear 45M rotates in the clockwise direction.

Also, the paddle 74M of the first rotating member 71M in the first toner containing section 81M rotates. As the paddle 74M rotates, the toner having been supplied from the toner bottle 32M into the first toner containing section 81M is agitated, and some toner crosses over the dividing part 80M and is fed into the second toner containing section 82M.

Further, the second gear 47M in engagement with the first gear 46M and being connected to the second rotating member 72M in the second toner containing section 82M rotates in the counterclockwise direction to rotate the screw 77M. By the rotation of the screw 77M in the counterclockwise direction, the toner in the second toner containing section 82M is fed into the toner feeding pipe 43M which is in connection with the second toner containing section 82M via the toner discharger port 79.

On the outermost peripheral part of the screw 77M, a groove is formed, so that a toner feeding coil 78M provided in the toner feeding pipe 43M is embedded into and fixed to the groove on the screw 77M and rotates with the screw 77M. By feeding toner in the toner feeding pipe 43M in this way, even when the shape of the toner feeding pipe 43M is other than straight due to the restriction of the layout in the apparatus, it may become possible to easily feed the toner.

As described above, the toner feeding pipe 43M is in connection with the second toner containing section 82M of the sub-hopper 48 via the toner discharger port 79, and includes the toner feeding coil 78M serving as a feeding member and made of resin in the toner feeding pipe 43M. Further, as the screw 77M formed as the second rotating member 72M rotates, the toner feeding coil 78M also rotates to supply toner to the toner supply port of the developer containing section 54M.

In this case, the toner discharger port 79M is formed so as to have a circular shape slightly greater than the outer diameter of the screw 77M and the toner feeding coil 78M. Further, the center of the toner discharger port 79M is coaxial with the rotational center of the second rotating member 72M.

On the toner bottle 32M side, there are a drive transmission gear 44M illustrated in a dotted circle in FIG. 5 and provided on the resin case 34M, plural drive transmission gears (not shown), and a rotation gear (not shown) integrally mounted on the bottle main body 33M.

Further, when the driving motor M rotates, the supply drive transmission gear 45M illustrated in the dotted circle and in engagement with the driving motor M is driven to rotate in the counterclockwise direction, and then the drive transmission gear 44M illustrated in the dotted circle in FIG. 5 rotates in the clockwise direction.

Then, the rotary drive of the drive transmission gear 44M is transmitted to the bottle main body 33M via plural drive transmission gears (not shown), so that the bottle main body 33M that integrally rotates with the bottle rotation gear M (not shown) of the toner bottle 32M rotates in the counterclockwise direction.

Further, there is a spiral-shaped developer guide groove (not shown) formed on the inner surface of the inner wall of the bottle main body 33M. Due to the developer guide groove, when the bottle main body 33M rotates, the toner inside the bottle main body 33M is fed from the side opposite to the resin case 34M (back side of the bottle main body 33M) to the resin case 34M side.

The toner having fed to the resin case 34M side passes through a toner feeding path (not shown) in the resin case 34M, and is dropped into the inside of the first toner containing section 81M of a sub-hopper 48M. through a toner drop port.

Further, there is a piezoelectric toner detection sensor 60M provided on a side wall of the first toner containing section 81M on the side which is separated from the side of the second toner containing section 82M, so that the toner detection sensor 60M detects a toner near end state and toner end state of the toner bottle 32M.

This toner detection sensor 60M includes a sensor detection surface 61. The toner detection sensor 60M detects whether there is toner on the sensor detection surface 61.

More specifically, the toner detection sensor 60M is controlled to detect (determine) that there is toner when the sensor detection surface 61 of the toner detection sensor 60M is covered with toner up to near the center height of the sensor detection surface 61 while toner is agitated by the rotation of the paddle 74M.

As described above, the toner supplied to the development device 5M is fed from the upstream side of the toner feeding direction in the order of the bottle main body 33M, the resin case 34M, the first toner containing section 81M, the second toner containing section 82M, and the toner feeding pipe 43M.

All the rotating bodies simultaneously rotate by the rotation of the driving motor M due to a supply signal from a control section 57M when the density detection sensor 56M of the development device 5M detects insufficient toner density in the developer containing section 54M.

By doing this, the toner density in the development device 5M is adjusted and unless the toner is depleted in the toner bottle 32M, the state where the toner amount in the sub-hopper 48 is equal to or greater than a predetermined amount is normally maintained.

Further, when the toner feeding coil 78M in the toner feeding pipe 43M is made of a metal, agglomerated cores of toner may be generated due to the friction between the outer peripheral surface of the toner feeding coil 78M made of the metal and the inner peripheral surface of the toner feeding pipe 43M.

Due to the generated agglomerated cores, an abnormal image having white decolorization or the like may be formed. To avoid the problem, in the toner supply devices 40M in this embodiment, a feeding coil made of resin is used so as to reduce the friction between the outer peripheral surface of the toner feeding coil 78M made of resin and the inner peripheral surface of the toner feeding pipe 43M.

By doing this, it may become possible to reduce the generation of the agglomerated cores of toner, and reduce the occurrence of the abnormal image having white decolorization or the like.

In the following, more details of the sub-hopper 48 of the toner supply devices 40 are described with reference to some examples. In the following, the sub-hoppers 48Y, 48M, 48C, and 48K have substantially the same configuration.

In the descriptions of the example below, the descriptions of the symbols "Y", "M", "C", and "K" may be omitted. Further, the same reference numerals are used for the same elements and the corresponding sizes, and the repeated descriptions thereof may be omitted.

Further, the repeated descriptions already explained in the above outline of the image forming apparatus in this embodiment (i.e., the configuration and the operations of the toner supply devices 40) may also be omitted.

Example 1

First, an example 1 corresponding to a first example of the sub-hopper 48 in this embodiment is described with reference to the drawings.

Figure 7:
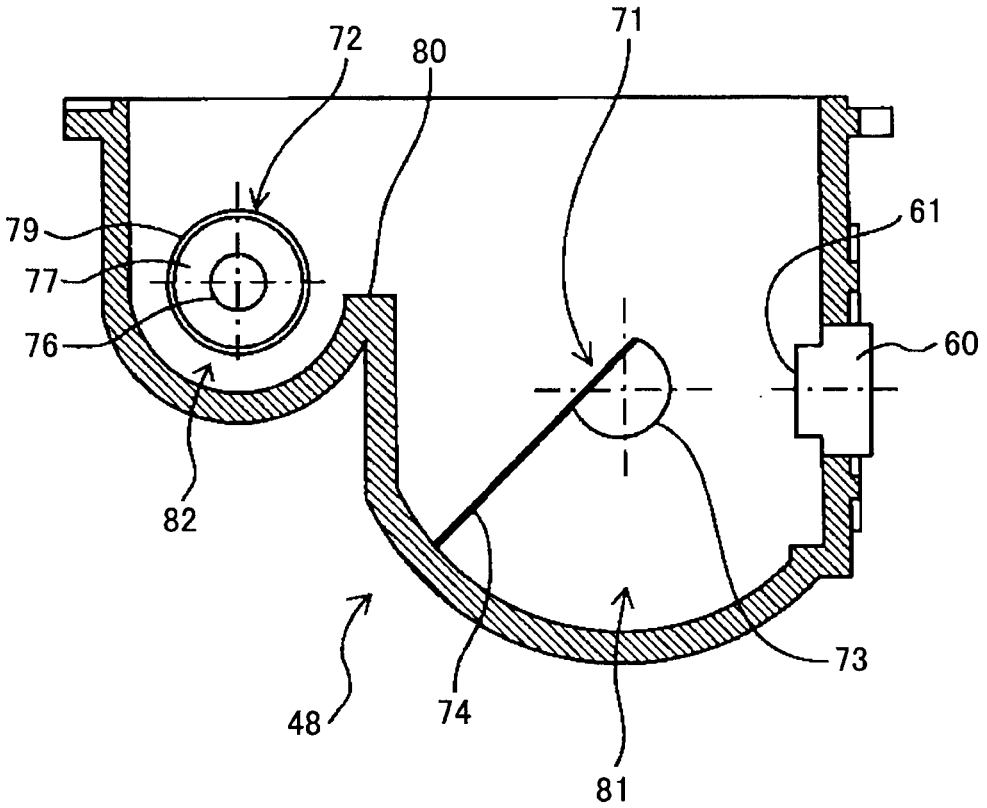
FIG. 7 is a cross-sectional view of the sub-hopper according to a first example.
Figure 8B:
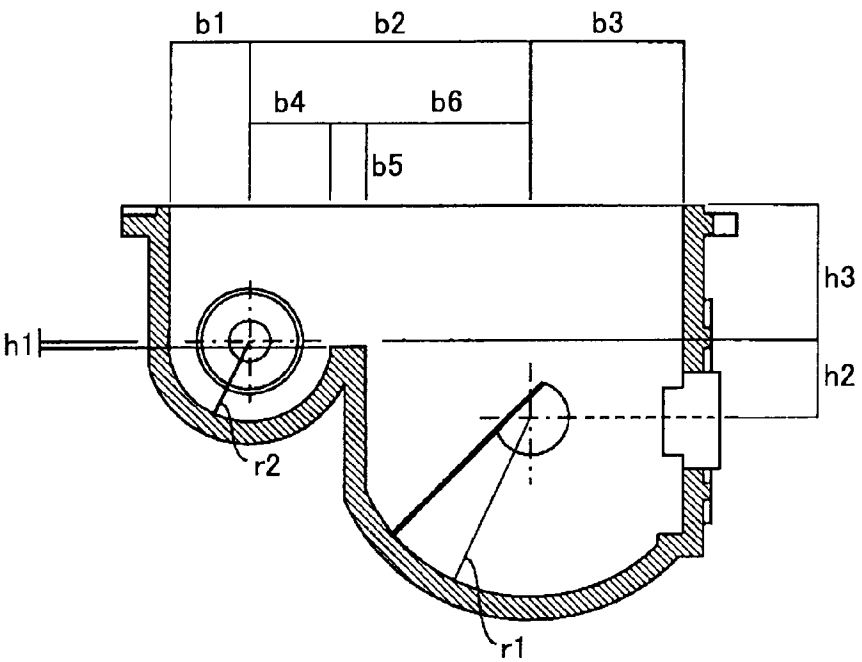
FIG. 8B is a drawing illustrating sizes of the sub-hopper.
Figure 8A:
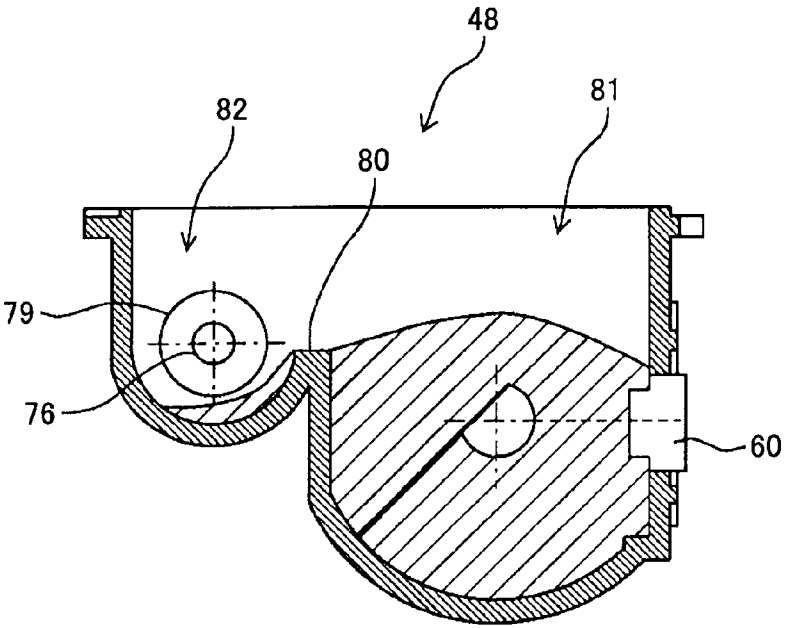
FIG. 8A is a drawing of the sub-hopper containing toner.

FIG. 7 is a cross-sectional view of the sub-hopper 48 in this first example. FIG. 8A illustrates the sub-hopper 48 containing toner and FIG. 8B illustrates the sizes of the sub-hopper 48. FIG. 9 is a cross-sectional view of a sub-hopper of a comparative example.

Figure 10B:
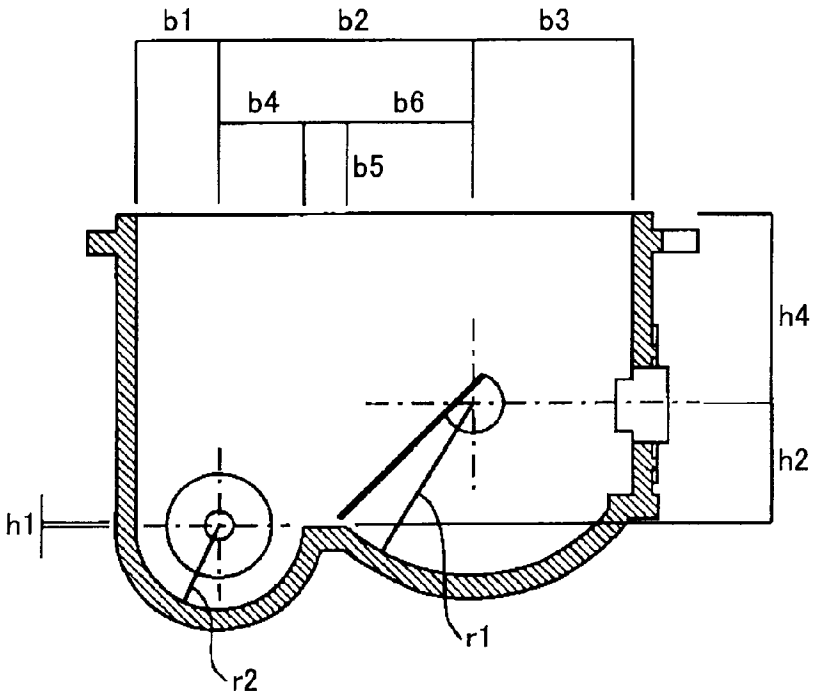
FIG. 10B is a drawing illustrating sizes of the sub-hopper of the comparative example.
Figure 10A:
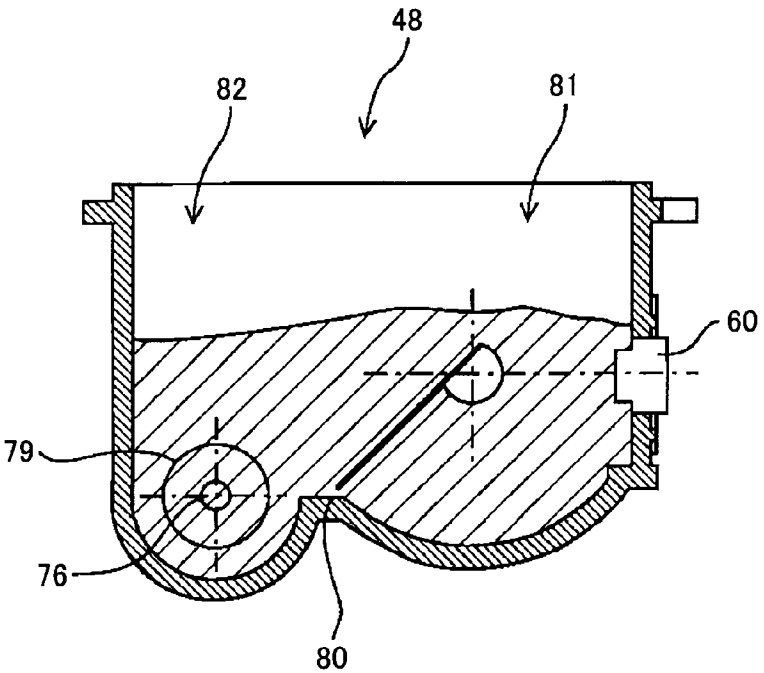
FIG. 10A is a drawing of the sub-hopper in the comparative example containing toner.

FIG. 10A illustrates the sub-hopper containing toner in the comparative example. FIG. 10B illustrates the sizes of the sub-hopper of the comparative example.

Figure 11B:
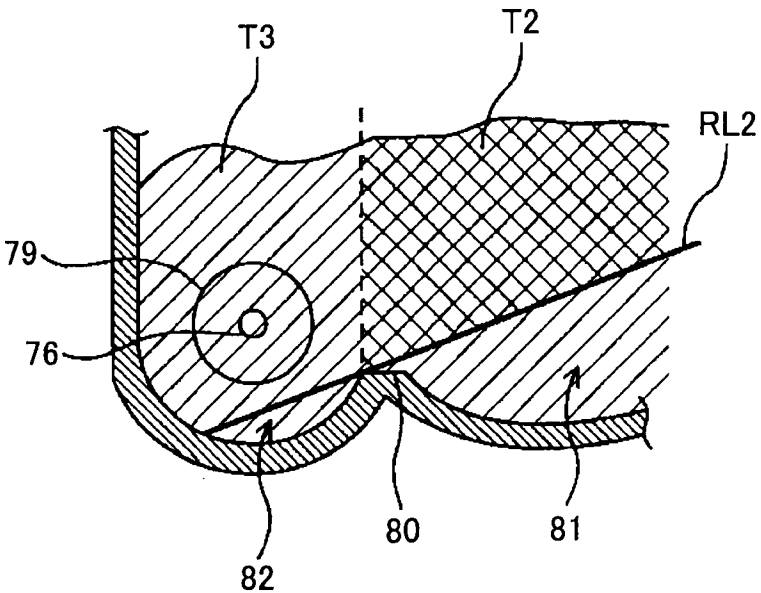
FIG. 11B is a drawing illustrating the angle of repose of toner in the comparative example.
Figure 11A:
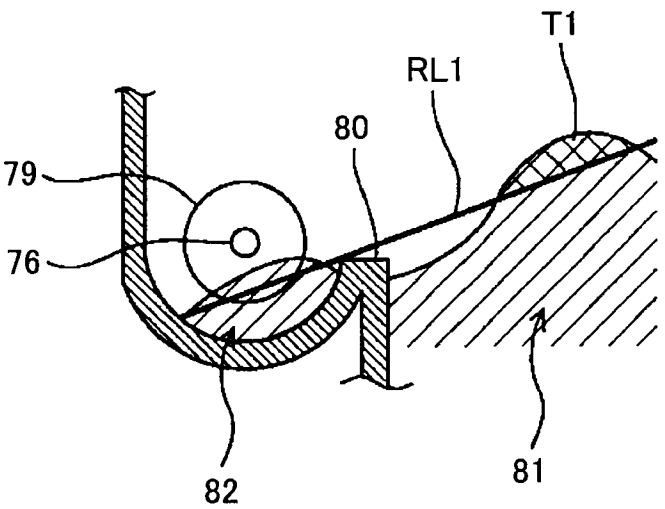
FIG. 11A is a drawing illustrating an angle of repose of toner in the first example.

FIG. 11A illustrates an Angle of Repose of toner in the first example, and FIG. 11B illustrates the Angle of Repose of toner in the comparative example.

As illustrated in FIG. 7, in the sub-hopper 48 of this example, there are the first toner containing section 81 on the upstream side in the toner feeding direction and the second toner containing section 82 on the downstream side in the toner feeding direction, in a manner such that the first toner containing section 81 and the second toner containing section 82 are disposed side by side.

Further, the rotational center of the second rotating member 72 provided in the second toner containing section 82 is higher than the rotational center of the first rotating member 71 provided in the first toner containing section 81.

Further, the rotational center of the second rotating member 72 is disposed at a higher position so that the lowest position of the toner discharger port 79 of the second toner containing section 82 is higher than the rotational center of the first rotating member 71 provided in the first toner containing section 81.

Further, the first toner containing section 81 has a bottom part having an arc-shaped inner surface and is provided for receiving toner. The second toner containing section 82 has a bottom part having an arc-shaped inner surface and is provided for discharging toner through a toner discharger port 79.

The dividing part 80 is formed between the first toner containing section 81 and the second toner containing section 82 in a manner such that an opening is formed through which the toner in the first toner containing section 81 crosses over the dividing part 80 and fed to the second toner containing section 82.

Further, the upper end part (surface) of the dividing part 80 is higher than the rotational center of the first rotating member 71 on the upstream side in the toner feeding direction and is lower than the rotational center of the second rotating member 72.

As described above, the upper surface of the dividing part 80 is higher than the rotational center of the first rotating member 71.

Because of this feature, the amount of toner that is fed to the second toner containing section 82 after all the rotating members are stopped may be reduced when compared with the amount of toner that is fed to the second toner containing section 82 after all the rotating members are stopped in a conventional configuration or in the configuration in FIG. 9.

This may be achieved by at least the following reason.

The feeding (movement) of the toner from the first toner containing section 81 to the second toner containing section 82 after all the rotating members are stopped may typically occur in a manner such that the toner disposed on the upper side of the inclination of the "Angle of Repose" determined based on the flowability of the toner and the base point on the upper end portion of the dividing part 80 falls into the second toner containing section 82.

Therefore, when the position of the dividing part 80 becomes higher than that of the dividing part 80 in the conventional configuration or in the configuration in FIG. 9, the amount of toner that crosses over the dividing part 80 and falls (flows) into the second toner containing section 82 may be reduced by that.

Further, the toner may be sequentially fed to the second toner containing section 82 by the rotation of the first rotating member 71. Because of this feature, the position of the dividing part 80 may be higher as long as the toner can be fed to the second toner containing section 82 by the rotation of the first rotating member 71.

Therefore, in this example, the position of the upper end portion of the dividing part 80 is set at a higher position in a manner such that the most of the toner in the first toner containing section 81 can be disposed under the inclination of the "Angle of Repose" determined based on the flowability of the toner.

Further, the height (position) of the upper end portion of the dividing part 80 is determined in a manner such that when a typical amount of toner is dropped from the toner bottle 32, the toner is contained in the first toner containing section 81 but is not fed into the second toner containing section 82.

By providing (configuring) the dividing part 80 as described above, it may become possible to greatly reduce the amount of the toner that feeds to the second toner containing section 82 after the rotation of all the rotating members is stopped when compared with the amount of the toner that feeds to the second toner containing section 82 after the rotation of all the rotating members is stopped in the conventional configuration or the configuration in FIG. 9.

Next, details of the movement of the toner to the second toner containing section 82 after the rotation of the all the rotating members is stopped are described in the configuration in FIGS. 11A and 11B in this example and the configuration in FIG. 9.

In the configuration of this example, as illustrated in FIG. 11A, when the "Angle of Repose" corresponding to the flowability of the toner is given as "Θ", the inclination of the "Angle of Repose (Θ)" may be expressed as the straight line RL1 defined based on the end portion on the second toner containing section 82 side of the upper end surface of the dividing part 80.

Therefore, in this case, after the rotation of the all the rotating members is stopped, the toner disposed on the upper side of the straight line RL1 may flow in a manner such that the toner crosses over the dividing part 80 and falls into the second toner containing section 82.

However, as described above, in this example, the height of the upper end surface of the dividing part 80 is increased so that the most of the toner in the first toner containing section 81 is lower than the straight line RL1.

Because of this feature, it may become possible to greatly reduce the amount of the toner that feeds to the second toner containing section 82 after the rotation of all the rotating members is stopped when compared with the amount of the toner that feeds to the second toner containing section 82 after the rotation of all the rotating members is stopped in the conventional configuration or the configuration in FIG. 9 described below.

On the other hand, in the configuration of FIG. 9, as illustrated in FIG. 11B, when the "Angle of Repose" corresponding to the flowability of the toner is given as "Θ", the inclination of the "Angle of Repose (Θ)" may be expressed as the straight line RL2 defined based on the end portion on the second toner containing section 82 side of the upper end surface of the dividing part 80.

Therefore, after the rotation of the all the rotating members is stopped, the toner disposed on the upper side of the straight line RL2 may flow in a manner such that the toner crosses over the dividing part 80 and falls into the second toner containing section 82.

In the configuration of FIG. 9, however, the height of the upper end surface of the dividing part 80 is not sufficiently high, which means that much toner is upper than the straight line RL2. Therefore, the amount of the toner that feeds to the second toner containing section 82 after the rotation of all the rotating members is stopped.

Further, due to the insufficient height of the upper end surface of the dividing part 80, from among the toner T3 contained in the second toner containing section 82, the toner disposed higher than the lowest portion of the toner discharger port 79 is increased when compared with the configuration in this example.

Further, as illustrated in FIG. 10A, in a case where a new toner bottle 32 is connected to the sub-hopper 48 and the toner in the toner bottle 32 is dropped in the sub-hopper 48, when a typical amount of toner is dropped from the toner bottle 32, the toner may not be contained within the first toner containing section 81 alone, which means that some toner may be fed (moved) into the second toner containing section 82.

Further, the movement of the toner into the toner feeding pipe 43 from the second toner containing section 82 side via the toner discharger port 79 may occur when the toner disposed on the upper side of the inclination of the "Angle of Repose" determined based on the base point on the lowermost portion of the toner discharger port 79 and based on the flowability of the toner flows so as to fall.

Therefore, the amount of toner to be moved into the second toner containing section 82 after the rotation of the all the rotating members is stopped may be reduced. As a result, the amount of the toner to be newly added (accumulated) to the toner having been contained in the second toner containing section 82 after the rotation of the all the rotating members is stopped may accordingly be reduced by that.

Since the amount of the toner to be newly accumulated is reduced, the amount of the toner disposed on the upper side of the inclination of the "Angle of Repose" determined based on the base point on the lowermost portion of the toner discharger port 79 and based on the flowability of the toner may also be reduced.

Therefore, in the configuration of this example, unlike the configuration as illustrated in FIG. 9, it may become possible to prevent a larger amount of toner having excessively increased flowability from being fallen (fed) into the toner feeding pipe 43 and the development device 5 from the second toner containing section 82 even after the rotation of all the rotating members in the sub-hopper 48 and the toner feeding pipe 43 is stopped.

As a result, it may become possible to stably supply toner to the development device 5 while preventing (reducing) the initial flow and the continual flow.

Further, by having a simple configuration of the dividing part 80 higher than the rotational center of the first rotating member 71 as described above so that toner can be sequentially fed to the second toner containing section 82 by the rotation of the first rotating member 71, it may become possible to reduce the amount of toner to be fallen at a time.

Further, the toner detection sensor 60 is provided on a side wall of the first toner containing section 81 on the side which is separated from the side of the second toner containing section 82 in a manner such that the center height of the sensor detection surface 61 of the toner detection sensor 60 is substantially equal to the height of the rotational center of the first rotating member 71 of the first toner containing section 81.

In the toner supply device 40 in this example, the sub-hopper 48 is filled with a predetermined amount of toner or more and the toner is supplied from the sub-hopper 48 to the development device 5 under the control of the control section 57 based on the detection result of the density detection sensor 56 of the development device 5.

Simultaneously, the same amount of the toner as that of the toner reduced in the sub-hopper 48 is supplied from the toner bottle 32 to the sub-hopper 48. However, when the toner supply to the development device 5 is repeated and the toner in the toner bottle 32 is depleted, no toner may be supplied to the development device 5.

Therefore, in this example, the toner near end (near empty) state of the toner bottle 32 is detected (determined) when a no-toner signal is detected when the upper surface of the toner is lowered near the center height of the sensor detection surface 61 of the toner detection sensor 60.

Further, the toner end (empty) state is detected (determined) when a predetermined time period has passed since the toner near end state is detected. The predetermined time period may be determined based on experiments.

When determining the toner near end state, for example, a message indicating the toner near end state or the like is displayed on an operation panel (not shown) or alarm is ringing to inform the user of the state.

When determining the toner end state, the image forming operation is stopped and, for example, a message indicating the toner end state or the like is displayed on the operation panel or alarm is ringing to inform the user of the state.

In this example, as the toner detection sensor 60, a piezoelectric oscillation type (piezoelectric type) toner level sensor manufactured by TDK Corporation is used.

Further, the first rotating member 71 provided in the first toner containing section 81 is a surface formed in a manner such that a part of the cross-section of the first rotational axis 73M of the first rotating member 71 is notched (cut) and a paddle 74 as a plate-shaped elastic member is attached to the surface.

In this case, when the paddle 74 does not reach the inner surface of the arc-shaped bottom part of the first toner containing section 81, all the toner may not be fed. The header part of the paddle 74 is designed (configured) so as to reach the inner surface of the arc-shaped bottom part of the first toner containing section 81.

By the rotation of the paddle 74, the toner having been supplied into the first toner containing section 81 is agitated and a part of the toner is supplied to the second toner containing section 82. By having the configuration described above, it may become possible to appropriately and effectively feed the toner from the first toner containing section 81 to the second toner containing section 82 and agitate the toner.

As a result, it may become possible to make it easier to stably feed the toner to the development device 5, maintain the toner density in the development device 5 at a normal level, and develop an image having an appropriate density. Further, on the paddle 74, an opening parallel to the first rotating member 71 is formed.

Due to the opening on the paddle 74, it may become possible to minimize the agitation and fill the space created by the rotation of the paddle 74 and near the sensor detection surface 61 with the toner. In this example, as the paddle 74, a "Lumirror" which is a PET (PolyEthylene Terephthalate) film having a thickness of 0.1 mm manufactured by Toray industries, inc. is used.

However, any other appropriate film-like elastic member other than the "Lumirror" may be used as the paddle 74 as long as the film-like elastic member meets the desired conditions including desired elastic force and abrasion resistance.

Further, to feed the toner from the sub-hopper 48 to the toner feeding pipe 43, by using the spiral screw 77, it may become possible to feed the toner with sufficient feeding force even when the toner feeding pipe 43 having smaller size (diameter) of the cross section of the toner feeding pipe 43.

As a result, it may become possible to stably feed the toner to the development device 5, maintain the toner density in the development device 5 at a normal level, and develop an image having an appropriate density.

Next, comparative experiments conducted to confirm the effects of this example by comparing the initial flow and the continual flow in the sub-hopper in this example of FIG. 7 and those in the sub-hopper having the configuration of FIG. 9 as comparative example are described.

First, experimental conditions in the comparative experiments are describe with reference to FIGS. 8B and 10B.

The followings items are common between the configuration in this example and the configuration of the comparative example.

Depth of the toner containing section (D in FIG. 6): 26.0 mm;

Diameter of first rotational axis 73: 6.0 mm;

Diameter of second rotational axis 76: 2.0 mm;

Outermost diameter of screw 77: 7.0 mm;

Inner diameter of toner discharger port 79: 7.3 mm;

Radius between rotational center of second rotating member 72 and arc-shaped bottom part of second toner containing section 82 (r2): 6.0 mm;

Thickness of paddle 74: 0.1 mm;

Length between cross point between perpendicular line from rotational center of first rotating member 71 to paddle 74 and end of paddle 74 (hereinafter foot length of paddle 74): Radius between rotational center of first rotating member 71 and arc-shaped bottom part of first toner containing section 81 (r1)+1.0 mm;

Length between rotational center of first rotating member 71 and cross point between perpendicular line from rotational center of first rotating member 71 to paddle 74 (t): 1.6 mm;

Horizontal length between rotational center of second rotating member 72 and perpendicular inner wall surface on side separated from first toner containing section 81 (b1): 6.0 mm;

Number of Rotations per unit time of first rotating member 71: 440 rpm;

Number of Rotations per unit time of second rotating member 72: 538 rpm;

Toner supply amount to first toner containing section 81 per unit time: 0.30 to 0.50 g/s; and Target value of toner supply amount per unit time: 0.42 g/s.

Experimental conditions of the configuration in this example of FIG. 7 are as follows:

Radius between rotational center of first rotating member 71 and arc-shaped bottom part of first toner containing section 81 (r1): 13.4 mm;

Horizontal length between rotation center of first rotating member 71 and rotation center of second rotating member 72 (b2): 21.1 mm;

Horizontal length between rotational center of first rotating member 71 and perpendicular inner wall surface on side where toner detection sensor 60 is provided (b3): 11.4 mm;

Horizontal length between rotational center of second rotating member 72 and end portion of second rotating member 72 close to upper end portion of dividing part 80 (b4): 5.8 mm;

Width of upper end portion of dividing part 80 (b5): 3.0 mm;

Horizontal length between rotational center of first rotating member 71 and end portion of first rotating member 71 close to upper end portion of dividing part 80 (b6): 12.5 mm;

Vertical height from upper end portion of dividing part 80 to rotational center of second rotating member 72 (h1): 1.5 mm;

Vertical length between rotational center of first rotating member 71 and rotational center of second rotating member 72 (h2): 6.0 mm; and Vertical length between rotational center of second rotating member 72 and upper end of inner wall of sub-hopper 48 (h3): 13.0 mm.

Experimental conditions of the configuration in comparative example of FIG. 9 are as follows:

Radius between rotational center of first rotating member 71 and arc-shaped bottom part of first toner containing section 81 (r1): 12.4 mm;

Horizontal Length between rotation center of first rotating member 71 and rotation center of second rotating member 72 (b2): 18.0 mm;

Horizontal length between rotational center of first rotating member 71 and perpendicular inner wall surface on side where toner detection sensor 60 is provided (b3): 11.5 mm;

Horizontal length between rotational center of second rotating member 72 and end portion of second rotating member 72 close to upper end portion of dividing part 80 (b4): 6.0 mm;

Width of upper end portion of dividing part 80 (b5): 3.1 mm;

Horizontal length between rotational center of first rotating member 71 and end portion of first rotating member 71 close to upper end portion of dividing part (b6): 9.0 mm;

Vertical height from upper end portion of dividing part 80 to rotational center of second rotating member 72 (h1): ±0 mm;

Vertical length between rotational center of first rotating member 71 and rotational center of second rotating member 72 (h2): 8.7 mm; and Vertical length between rotational center of first rotating member 71 and upper end of inner wall of sub-hopper 48 (h4): 9.8 mm.

Under the above conditions, the comparative experiments were conducted. Based on the estimations of the inventor of the present invention, the initial flow with amount of 1 to 4 g (average 2.12 g and the number of measurements were 10 times) were observed in the comparative configuration of FIG. 9.

On the other hand, no initial flow were observed (measurements were 10 times) in the configuration in this example of FIG. 7 having substantially the same toner capacity as that in the comparative configuration of FIG. 9. Further, the continual flow were observed in the comparative configuration of FIG. 9 when a ratio of a time period of toner feeding operation to a time period of image forming operation exceeds 50%.

The supply amount per unit time is increased up to 2.5 times. On the other hand, no continual flow were observed in the configuration in this example of FIG. 7 even when the ratio of a time period of toner feeding operation to a time period of image forming operation is 80%.

Based on the evaluation results of the experiments, it may be confirmed that the configuration of the sub-hopper 48 according to this example greatly contributes to the reduction of the toner fall phenomena (i.e., the initial flow and the continual flow).

In the above descriptions, a case is described that the sub-hopper 48 includes two toner containing sections (i.e., the first toner containing section 81 and the second toner containing section 82).

However, the present invention is not limited to this configuration. Namely, the present invention may also be applied to the sub-hopper including more than two toner containing sections.

Example 2

Next, an example 2 corresponding to a second example of the sub-hopper 48 in this embodiment is described with reference to the drawings. The configuration in this example 2 differs from the configuration in the above example 1 only in that the upper end portion of dividing part 80 is higher than the rotational center of second rotating member 72 provided in the second toner containing section 82 on the downstream side in the toner feeding direction.

Figure 12:
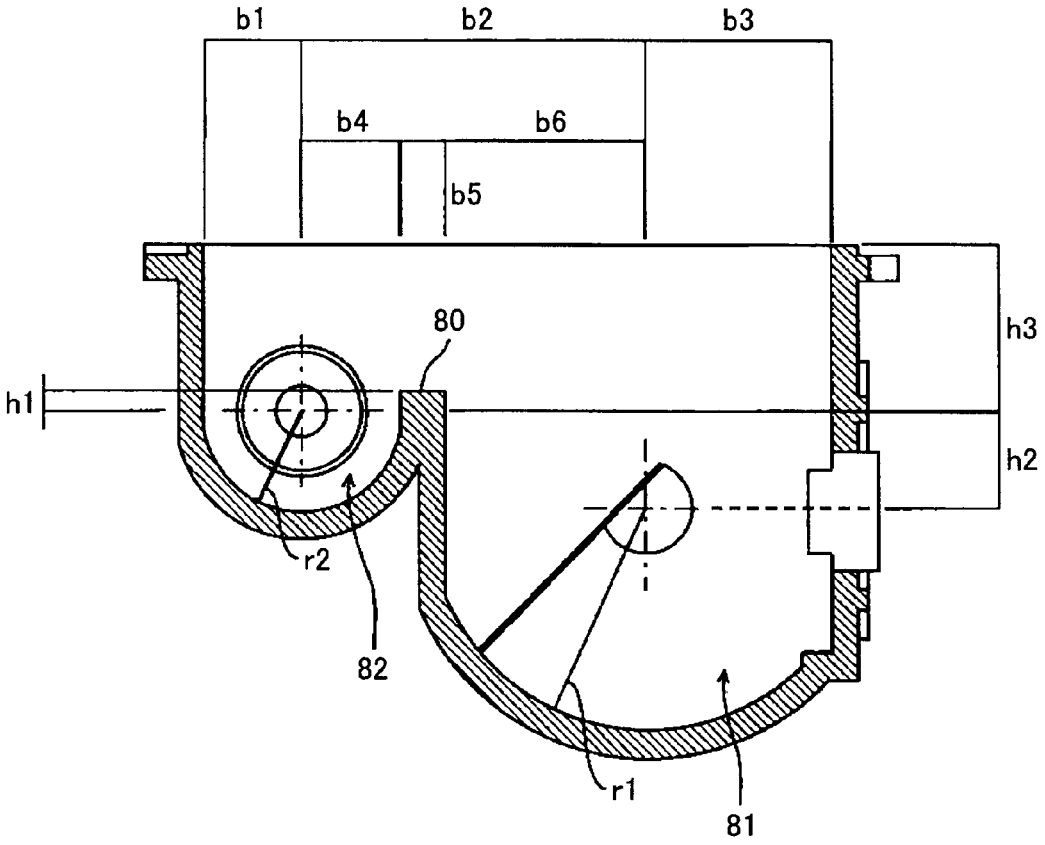
FIG. 12 is a cross-sectional view illustrating sizes of the sub-hopper according to a second example.

Therefore, descriptions of the configurations, the operations, and the effects common to those in the first example may be omitted. FIG. 12 is a cross-sectional view illustrating sizes of the sub-hopper in this example.

Figure 13:
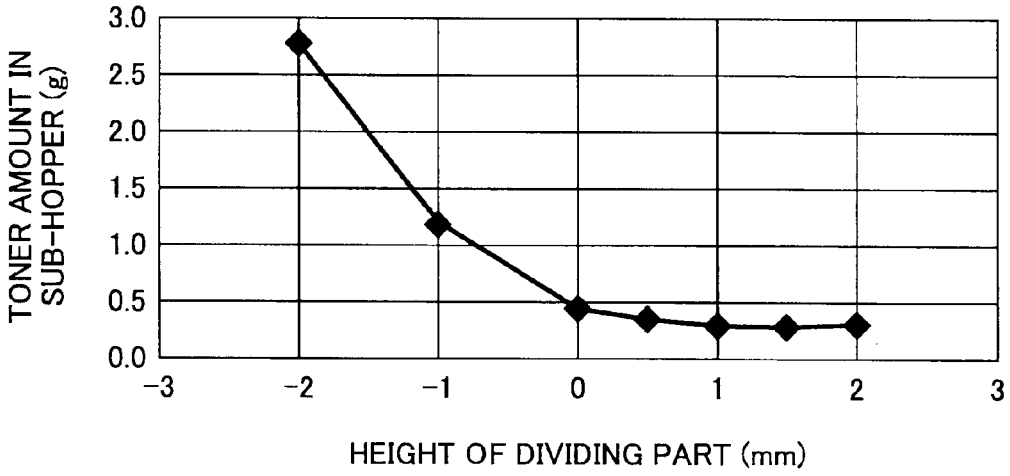
FIG. 13 is a graph illustrating a relationship between height of dividing plate and toner amount remaining in the sub-hopper.
Figure 14:
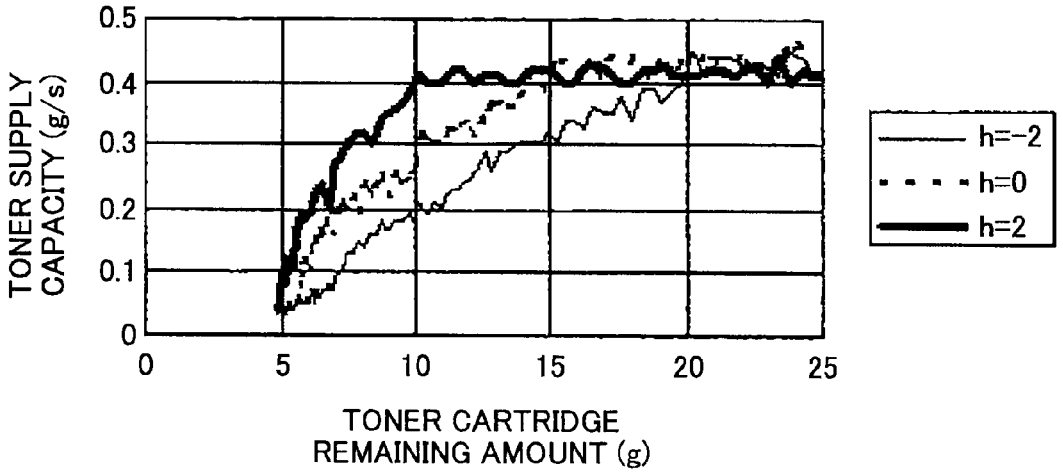
FIG. 14 is a graph illustrating a relationship between toner amount remaining in a toner cartridge and toner supply capability.

FIG. 13 is a graph illustrating a relationship between height of dividing plate and toner amount remaining in the sub-hopper. FIG. 14 is a graph illustrating a relationship between toner amount remaining in a toner cartridge and toner supply capability.

As illustrated in FIG. 12, the sub-hopper 48 in this embodiment, the upper end portion of dividing part 80 is higher than the rotational center of second rotating member 72 by h1. In contrast, if the upper end portion of dividing part 80 is lower than the rotational center of second rotating member 72, the following inconvenience may occur.

Namely, when there is no toner remaining in the toner bottle 32 (i.e., in the toner end state), toner may flow back by feeding from the second toner containing section 82 to the first toner containing section 81. As a result, the toner in the sub-hopper 48 may not be effectively used.

In view of the convenience, in this example, the upper end portion of dividing part 80 is higher than the rotational center of second rotating member 72 provided in the second toner containing section 82 on the downstream side in the toner feeding direction.

Next, to evaluate the effect in this example, an experiment to measure the relationship between the height of the upper end portion of dividing part 80 and the amount of toner remaining in the sub-hopper 48, and an experiment to measure the relationship between the amount of toner remaining in a toner cartridge and toner supply capability were conducted.

Basically, the conditions in the experiments are the same as those in the experiments conducted in the configuration of FIG. 7 in the first example except some different sizes in both vertical and horizontal directions and the like caused by increasing the height of the upper end portion of dividing part 80.

Those different sizes and the like are described. Herein, descriptions of the same configurations as those in FIG. 7 used in the experiments in example 1 may be omitted.

Experimental conditions of the configuration in this example of FIG. 12 are as follows:

Horizontal length between rotational center of second rotating member 72 and perpendicular inner wall surface on side separated from first toner containing section 81 (b1): 6.0 mm;

Horizontal Length between rotation center of first rotating member 71 and rotation center of second rotating member 72 (b2): 21.1 mm;

Horizontal length between rotational center of first rotating member 71 and perpendicular inner wall surface on side where toner detection sensor 60 is provided (b3): 11.4 mm;

Horizontal length between rotational center of second rotating member 72 and end portion of second rotating member 72 close to upper end portion of dividing part 80 (b4): 6.0 mm;

Width of upper end portion of dividing part 80 (b5): 2.8 mm;

Horizontal length between rotational center of first rotating member 71 and end portion of first rotating member 71 close to upper end portion of dividing part 80 (b6): 12.5 mm;

Vertical height from rotational center of second rotating member 72 to upper end portion of dividing part 80 to (h1): 1.4 mm;

Vertical length between rotational center of first rotating member 71 and rotational center of second rotating member 72 (h2): 6.0 mm;

Vertical length between rotational center of second rotating member 72 and upper end of inner wall of sub-hopper 48 (h3): 13.0 mm.

Number of Rotations per unit time of first rotating member 71: 440 rpm;

Number of Rotations per unit time of second rotating member 72: 538 rpm;

Toner supply amount to first toner containing section 81 per unit time: 0.30 to 0.50 g/s; and Target value of toner supply amount per unit time: 0.42 g/s.

As illustrated in the graph of FIG. 13, when the upper end portion of dividing part 80 is higher than the rotational center of second rotating member 72, the amount of toner remaining in the sub-hopper 48 is reduced to almost none.

Namely, it may become possible to feed most of the toner in the sub-hopper 48 to the development device 5. As a result, it may become possible to elongate the time period between when the toner near end state is detected by the toner detection sensor 60 and when the toner end state is detected by the toner detection sensor 60, which may enhance the usability for the user of the printer 100.

The graph of FIG. 14 illustrates the toner supply capacity (capability) (g/s) to supply toner from the sub-hopper 48 to the development device 5 relative to the amount of toner remaining in the toner cartridge while setting the vertical height "h" from the rotational center of second rotating member 72 to the upper end portion of dividing part 80 to −2 mm, 0 mm, and 2 mm.

The graph of FIG. 14 illustrates that when the toner amount in the toner bottle 32 is equal to or greater than approximately 20.0 g, substantially the same toner supply capacity were observed in all the vertical heights "h". However, as the toner amount in the toner bottle 32 is decreased, different toner supply capacity were observed.

Specifically, in a case of "h=−2 (mm)", the toner supply capacity had begun to reduce when the toner amount in the toner bottle 32 (toner cartridge) is reduced less than approximately 20.0 g. In a case of "h=0 (mm)", the toner supply capacity had begun to reduce when the toner amount in the toner bottle 32 (toner cartridge) is reduced less than approximately 15.0 g.

In a case of "h=2 (mm)", the toner supply capacity had begun to reduce when the toner amount in the toner bottle 32 (toner cartridge) is reduced less than approximately 10.0 g. As a result, when h=2 (mm), substantially the same toner supply capacity was observed until the least toner amount remains in the toner bottle 32 (toner cartridge).

This result may explain that the vertical height "h" from the rotational center of second rotating member 72 to the upper end portion of dividing part 80 influences the toner supply capacity to supply toner from the sub-hopper 48 to the development device 5.

Namely, in a case where the toner end state is detected based on the toner supply capacity, if the range where the toner supply capacity is substantially constant can be expanded by increasing the vertical height "h" value, it may become possible to determine the toner end state more appropriately and effectively.

Based on the results of the experiments, at least by setting the position of the upper end portion of dividing part 80 higher than the position of the rotational center of second rotating member 72, (i.e., by setting the higher value "H", for example, as the vertical height "h") it may become possible to determine the toner end state more appropriately and effectively when compared with the case where the vertical height value is lower than "H".

Example 3

Next, an example 3 corresponding to a third example of the sub-hopper 48 in this embodiment is described with reference to the drawings. The configuration in this example 3 differs from the configuration in the above examples 1 and 2 only in that the foot length of the paddle 74 is defined by using the upper end portion of dividing part 80 as the base point.

Figure 15:
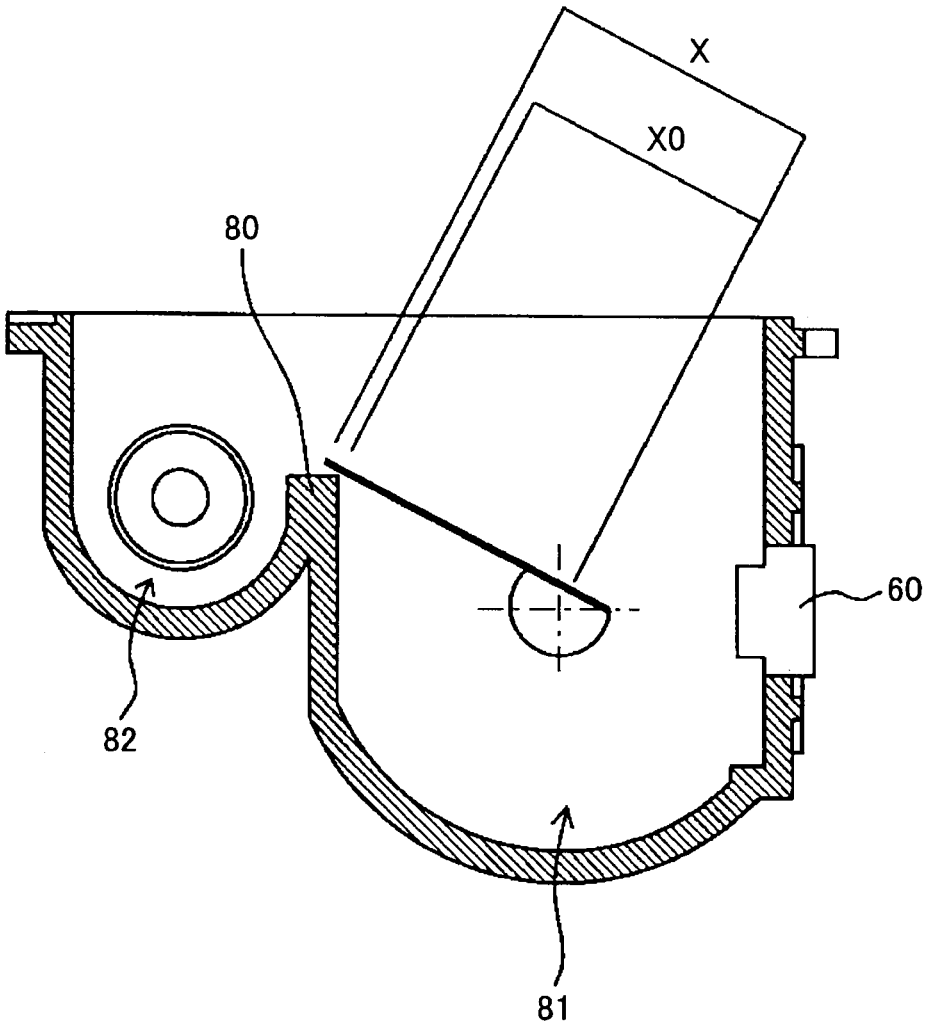
FIG. 15 illustrates a foot length of a paddle of the sub-hopper according to a third example.

Therefore, descriptions of the configurations, the operations, and the effects common to those in first or second example may be omitted. FIG. 15 illustrates the foot length of the paddle of the sub-hopper in this example. FIG. 16 is a table illustrating variation of a toner supply amount relative to the foot length of the paddle of the sub-hopper.

There may be a close relationship between the foot length of the paddle 74 provided on the first rotating member 71 of the first toner containing section 81 and the stability of the toner supply from the sub-hopper 48 to the development device 5. Specifically, when the foot length of the paddle 74 is too short, the toner supply capacity may be reduced.

The reduction (degradation) of the toner supply capacity occurs because when the foot length of the paddle 74 is too short, the toner amount in the second toner containing section 82 may vary. As a result, temporary depletion of toner may occur, thereby generating air holes in the toner feeding pipe 43.

To overcome the problem, in this example, as illustrated in FIG. 15, the foot length (X) of the paddle 74 is determined to be greater than the foot length ($X_0$) of the paddle 74 in a manner such that the edge portion of the paddle 74 is in contact with the edge of the upper end portion of dividing part 80 on the first toner containing section 81 side.

By determining the foot length of the paddle 74 in this way, it may become possible to reduce the variation of the toner supply from the sub-hopper 48 to the development device 5, stabilize the toner supply operation, and form an image having an appropriate image density.

Next, to evaluate the effect in this example, an experiment to measure the relationship between the foot length of the paddle 74 of the sub-hopper 48 and the toner supply amount in the sub-hopper 48 per unit time was conducted.

Basically, the conditions in the experiment are the same as those in the experiments conducted in the configuration of FIG. 12 in the second example except some different configurations. Those different configurations are described. Herein, descriptions of the same configurations such as the diameters of the axis members as those in FIG. 12 used in the experiments in example 2 may be omitted.

Experimental conditions of the configuration in this example of FIG. 15 are as follows:

Thickness of paddle 74: 0.1 mm;

Foot length ($X_0$) of paddle 74: 13.2 mm;

Foot length (X) of paddle 74: 12.0 mm, 13.0 mm, 13.5 mm, 14.0 mm, 14.5 mm, and 15.0 mm;

Toner amount contained in toner bottle 32 for each measurement: 50.0 g;

Number of Rotations per unit time of first rotating member 71: 440 rpm;

Number of Rotations per unit time of second rotating member 72: 538 rpm;

Toner supply amount to first toner containing section 81 per unit time: 0.30 to 0.50 g/s; and Target value of toner supply amount per unit time: 0.42 g/s.

Under the above conditions, the relationship between the time period when toner is discharged (supplied) through the toner discharger port 79 and the amount of toner remaining in the toner bottle 32 after the toner is discharged was measured while changing the paddles 74 having different five foot lengths.

Then, for each of the foot lengths of the paddles 74, the "maximum value", the "minimum value", the "average value", and the "standard deviation" of the toner supply amount (discharge amount) per unit time were measured.

The table of FIG. 16 illustrates the results of the measurements. Herein, the target value of toner supply amount per unit time is 0.42 g/s. However, the inventor of the present invention paid attention to the decrease (i.e., the "minimum value") of the toner supply amount per unit time which may be more likely to negative influence to image forming.

Therefore, the inventor of the present invention conducted the experiment by setting the allowable range of the toner supply amount per unit time to ±20% (i.e., by determining that the lower limit of the allowable range is 0.34).

Based on the experiment, the foot length (X) of the paddle 74 that satisfied the condition that the minimum value was 0.34 or more were 13.5 mm, 14.0 mm, 14.5 mm, and 15.0 mm. The evaluation results may explain that at least it is necessary that the foot length of the paddle 74 is long enough to be in contact with the edge portion of the dividing part 80.

Example 4

Next, an example 4 corresponding to a fourth example of the sub-hopper 48 in this embodiment is described with reference to the drawings. The configuration in this example 4 differs from the configuration in the above examples 1, 2, and 3 only in that the toner detection sensor 60 in the sub-hopper 48 is disposed higher than the upper end portion of dividing part 80.

Figure 17:
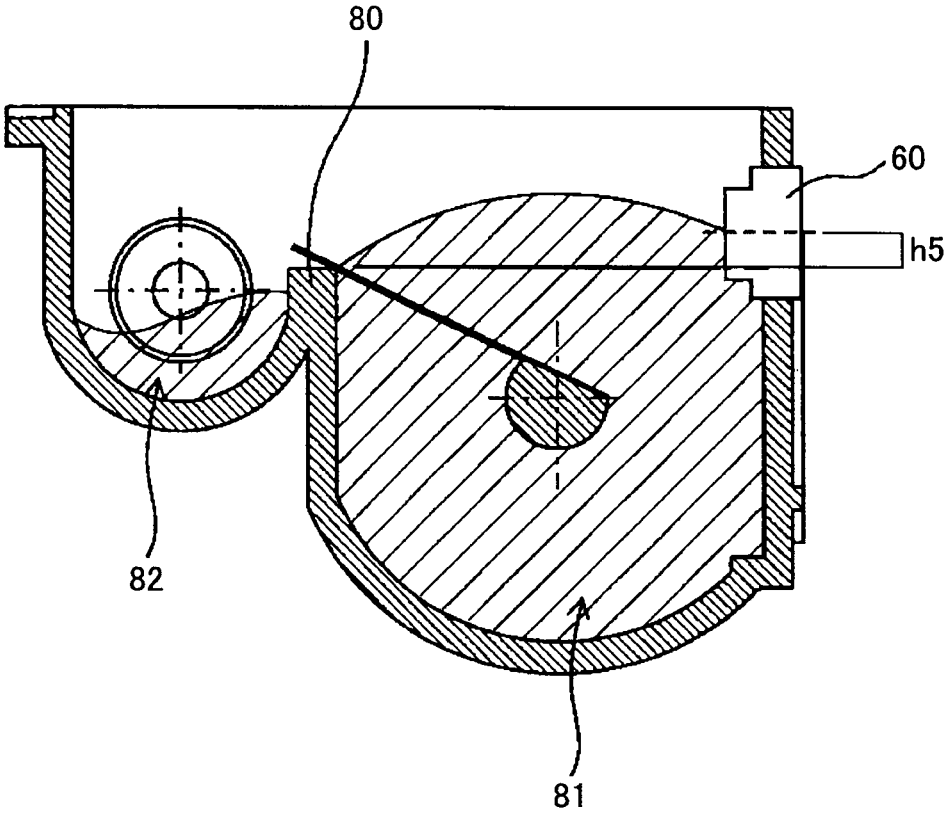
FIG. 17 is a drawing illustrating a position of the a toner detection sensor in a sub-hopper according to a fourth example.

Therefore, descriptions of the configurations, the operations, and the effects common to those in first, second, or third example may be omitted. FIG. 17 illustrates a position of the toner detection sensor 60 in the sub-hopper 48 in the fourth example.

As illustrated in FIG. 7, the piezoelectric toner detection sensor 60 may be disposed in the side wall surface of the first toner containing section 81, so that the toner end state is determined based on the output from the toner detection sensor 60.

Further, as illustrated in the figures of the examples 1 through 3, there are many cases where the height of the rotational center of first rotating member 71 provided in the first toner containing section 81 is substantially the same as the center height of the sensor detection surface 61 of the toner detection sensor 60.

However, in such a small sub-hopper 48 as described in this example, the time period between when the toner near end state is detected by the toner detection sensor 60 and when the toner end state is detected by the toner detection sensor 60 may become too short for the user. As a result, the operability may be degraded.

To reduce the degradation of the operability, in this example, as illustrated in FIG. 17, the toner detection sensor 60 is installed (disposed) in a manner such that the center of the sensor detection surface 61 of the toner detection sensor 60 is higher than the upper end portion of dividing part 80.

By doing this, when the amount of the toner in the first toner containing section 81 is reduced, it may become possible to determine, for example, the toner near end state earlier.

When the toner near end state can be determined earlier, it may become possible to elongate the time period between when the toner near end state is detected and when the toner end state is detected. As a result, it may become possible to enhance the operability of the image forming apparatus for the users.

As described above, in the toner supply device 40 of the printer 100 in this embodiment, the upper end portion (upper surface) of dividing part 80 is higher than the rotational center of first rotating member 71 provided in the first toner containing section 81.

Because of this feature, it may become possible to reduce the amount of toner that feeds (moves) to the second toner containing section 82 after the rotation of all the rotating members are stopped when compared with the conventional configuration and the configuration where the upper end portion (upper surface) of dividing part 80 is lower (not sufficiently high).

The above effect is achieved by the following reason(s). The feeding (movement) of the toner from the first toner containing section 81 to the second toner containing section 82 after all the rotating members are stopped may typically occur in a manner such that the toner disposed on the upper side of the inclination of the "Angle of Repose" determined based on the flowability of the toner and based on the base point on the upper end portion of the dividing part 80 falls into the second toner containing section 82.

Therefore, when the position of the dividing part 80 becomes higher than that of the dividing part 80 in the conventional configuration or in the configuration where the upper end portion (upper surface) of dividing part 80 is lower (not sufficiently high), the amount of toner that crosses over the dividing part 80 and falls (flows) into the second toner containing section 82 may be reduced by that.

Further, by the rotation of the first rotating member 71, the toner is sequentially fed to the second toner containing section 82. Therefore, the height of the upper end portion (upper surface) of dividing part 80 may be increased (higher) as long as the toner can be fed to the second toner containing section 82 by the rotation of the first rotating member 71.

Therefore, the height of the upper end portion of dividing part 80 may be increased in a manner such that the most of the toner in the first toner containing section 81 may be disposed under the inclination of the "Angle of Repose" determined based on the flowability of the toner.

When the dividing part 80 is provided (configured) in this way, it may become possible to greatly reduce the amount of toner that feeds (moves) to the second toner containing section 82 after the rotation of all the rotating members are stopped when compared with the conventional configuration and the configuration where the upper end portion (upper surface) of dividing part 80 is lower (not sufficiently high).

Further, the movement of the toner into the toner feeding pipe 43 from the second toner containing section 82 side via the toner discharger port 79 is also based on the toner disposed on the upper side of the inclination of the "Angle of Repose" determined based on the base point on the lowermost portion of the toner discharger port 79 and based on the flowability of the toner flows so as to fall.

Therefore, the amount of toner to be moved into the second toner containing section 82 after the rotation of the all the rotating members is stopped may be reduced. As a result, the amount of the toner to be newly added (accumulated) to the toner having been contained in the second toner containing section 82 after the rotation of the all the rotating members is stopped may accordingly be reduced by that.

Since the amount of the toner to be newly accumulated is reduced, the amount of the toner disposed on the upper side of the inclination of the "Angle of Repose" determined based on the base point on the lowermost portion of the toner discharger port 79 and based on the flowability of the toner may also be reduced.

Therefore, it may become possible to prevent a larger amount of toner having excessively increased flowability from being fallen (fed) into the toner feeding pipe 43 and the development device 5 from the second toner containing section 82 even after the rotation of all the rotating members in the sub-hopper 48 and the toner feeding pipe 43 is stopped as occurred in the conventional configuration and the configuration where the upper end portion (upper surface) of dividing part 80 is lower (not sufficiently high).

As a result, it may become possible to stably supply toner to the development device 5 while preventing (reducing) the initial flow and the continual flow.

Further, by having the simple configuration of the dividing part 80 higher than the rotational center of the first rotating member 71 as described above so that the toner can be sequentially fed to the second toner containing section 82 by the rotation of the first rotating member 71, it may become possible to reduce the amount of toner to be fallen at a time and sequentially feed the toner by the rotation of the first rotating member 71.

Therefore, with the simple configuration described above, it may become possible to provide the toner supply device 40 that stably supply toner to the development device 5 while preventing (reducing) the initial flow and the continual flow.

Further, in the toner supply device 40 of the printer 100 in this embodiment, the upper end portion (upper surface) of dividing part 80 disposed between the first toner containing section 81 and the second toner containing section 82 is higher than the rotational center of second rotating member 72 in the second toner containing section 82.

By doing this, it may become possible to reduce the amount of toner remaining in the sub-hopper 48 almost to none. Namely, it may become possible to feed most of the toner in the sub-hopper 48 to the development device 5.

As a result, it may become possible to elongate the time period between when the toner near end state is detected by the toner detection sensor 60 and when the toner end state is detected by the toner detection sensor 60, which may enhance the usability for the user of the printer 100.

Further, in the toner supply device 40 of the printer 100 in this embodiment, the paddle 74 which is the plate-like elastic member included in the first toner containing section 81 is configured in a manner such that the edge portion of the paddle 74 is in contact with the edge of the upper end portion of dividing part 80 on the first toner containing section 81 side.

By determining the foot length of the paddle 74 in this way, it may become possible to reduce the variation of the toner supply from the sub-hopper 48 to the development device 5, stabilize the toner supply operation, and form an image having an appropriate image density.

Further, in the toner supply device 40 of the printer 100 in this embodiment, the toner detection sensor 60 is installed (disposed) in a manner such that the center of the sensor detection surface 61 of the toner detection sensor 60 is higher than the upper end portion of dividing part 80.

By doing this, when the amount of the toner in the first toner containing section 81 is reduced, it may become possible to determine the toner near end state earlier. Therefore, it may become possible to elongate the time period between when the toner near end state is detected and when the toner end state is detected.

As a result, it may become possible to enhance the operability of the image forming apparatus for the users.

Further, in the toner supply device 40 of the printer 100 in this embodiment, to feed the toner from the sub-hopper 48 to the toner feeding pipe 43, the spiral screw 77 is used along the second rotational axis 76.

By doing this, it may become possible to feed the toner with sufficient feeding force even when the toner feeding pipe 43 having smaller size (diameter) of the cross section of the toner feeding pipe 43.

As a result, it may become possible to stably feed the toner to the development device 5, maintain the toner density in the development device 5 at a normal level, and develop an image having an appropriate density.

Further, in the toner supply device 40 of the printer 100 in this embodiment, to feed the toner in the toner feeding pipe 43, the toner feeding coil 78M is used. By using the toner feeding coil 78M, it may become possible to feed the toner even when the toner feeding pipe 43 is bent.

Further, the structural limitation of the positional relationship between the sub-hopper 48 and the development device 5 may be practically removed, which may greatly contribute to the downsizing of the printer 100.

Further, the printer 100 according to an embodiment of the present invention includes the toner supply device 40 according to the embodiment of the present invention. Therefore, the same effects as those of the toner supply device 40 may be applied to the printer 100.

According to an embodiment of the present invention, a toner supply device includes a toner storage section temporarily storing toner supplied from a toner container and supplying the toner to a development device visualizing a latent image as a toner image, the latent image being formed on a latent image carrier.

Further the toner storage section includes plural toner containing sections arranged from an upstream side to a downstream side in a toner feeding direction and including respective rotating members rotating to feed the toner.

Further, a position of a rotational center of the rotating member included in the toner containing section on the downstream side in the toner feeding direction is higher than a position of the rotational center of the rotating member included in the toner containing section on the upstream side in the toner feeding direction.

Further, the rotating member of the toner containing section other than the toner containing section disposed on a downstreammost side in the toner feeding direction includes a plate-like elastic member rotating to feed the toner to an adjoining toner containing section disposed on the downstream side in the toner feeding direction.

Further, the toner storage section further includes a dividing part formed between the toner containing sections adjacent to each other and including an upper end part and side wall surfaces extended from arc-shaped bottom parts of the respective toner containing sections adjacent to each other so as to form an opening above the dividing part so that the toner can cross over the dividing part and feed from one of the toner storage sections to another via the opening.

Further, a position of the upper end part of the dividing part is higher than the position of the rotational center of the rotating member included in the toner containing section on the upstream side in the toner feeding direction of the toner containing sections adjacent to each other.

Further, the toner supplied to the toner containing section disposed on an upstreammost side in the toner feeding direction is sequentially fed to the toner containing section on the downstream side in the toner feeding direction by the rotation of the rotating member including the plate-like elastic member.

Further, the position of the upper end part of the dividing part may be higher than the position of the rotational center of the rotating member included in the toner containing section on the downstream side in the toner feeding direction of the toner containing sections adjacent to each other.

Further, the length between the edge portion of the plate-like elastic member on a side opposite to a side of the rotational center of the rotating member including the plate-like elastic member and the rotational center of the rotating member may be longer than a length between the rotational center of the rotating member and the upper end part of the dividing part on the downstream side of the toner feeding direction by the rotating member when the plate-like elastic member is not deformed.

Further, the toner storage section may further include a piezoelectric sensor provided on a wall surface of the toner containing section disposed on the upstreammost side in the toner feeding direction and configured to detect an amount of toner contained in the toner containing section and the position of the center height of a detection surface of the toner containing section may be higher than a position of the upper end part of the dividing part formed between the toner containing sections adjacent each other including the toner containing section having the wall surface on which the piezoelectric sensor is provided and the toner containing section disposed on the downstream side of the toner containing section having the wall surface on which the piezoelectric sensor is provided in the toner feeding direction.

Further, the rotating member of the toner containing section disposed on the downstreammost side in the toner feeding direction may include a spiral screw.

Further, the rotating member of toner containing section disposed on the downstreammost side in the toner feeding direction may include a spiral coil configured to rotate to feed the toner in a toner feeding path to feed the toner to the development device.

According to an embodiment of the present invention, an image forming apparatus includes any of the toner supply device described above.

According to an embodiment of the present invention, the upper end portion (upper surface) of dividing part is higher than the rotational center of the rotating member on the upstream side in the toner feeding direction.

Because of this feature, it may become possible to reduce the amount of toner that feeds (moves) to the toner containing section on the downstream side in the toner feeding direction after the rotation of all the rotating members are stopped when compared with the conventional configuration and the configuration where the upper end portion (upper surface) of dividing part is lower (not sufficiently high).

The above effect is achieved by the following reason(s). The feeding (movement) of the toner from the toner containing section on the upstream side to the toner containing section on the downstream side after all the rotating members are stopped may typically occur in a manner such that the toner disposed on the upper side of the inclination of the "Angle of Repose" determined based on the flowability of the toner and based on the base point on the upper end portion of the dividing part falls into the toner containing section on the downstream side.

Therefore, when the position of the upper end portion (upper surface) of the dividing part becomes higher than that of the dividing part in the conventional configuration or in the configuration where the upper end portion (upper surface) of dividing part 80 is lower (not sufficiently high), the amount of toner that crosses over the dividing part and falls (flows) into the toner containing section on the downstream side may be reduced by that.

Further, by the rotation of the first rotating member, the toner is sequentially fed to the toner containing section on the downstream side. Therefore, the height of the upper end portion (upper surface) of dividing part may be increased (higher) as long as the toner can be fed to the toner containing section on the downstream side by the rotation of the rotating member.

Therefore, the height of the upper end portion of dividing part 80 may also be increased until the most of the toner in the toner containing section on the upstream side is disposed under the inclination of the "Angle of Repose" determined based on the flowability of the toner.

When the dividing part is provided (configured) in this way, it may become possible to greatly reduce the amount of toner that feeds (moves) to the toner containing section on the downstreammost side in the toner feeding direction after the rotation of all the rotating members are stopped when compared with the conventional configuration and the configuration where the upper end portion (upper surface) of dividing part is lower (not sufficiently high).

Further, the movement of the toner in the toner containing section on the downstreammost side and the tube-like feeding path and a border part to the development device may also be based on the toner disposed on the upper side of the inclination of the "Angle of Repose" determined based on the base point of the border part and based on the flowability of the toner flows so as to fall.

Further, the amount of toner to be moved into the toner containing section on the downstreammost side after the rotation of the all the rotating members is stopped may be reduced. As a result, the amount of the toner to be newly added (accumulated) to the toner having been contained in the toner containing section on the downstreammost side after the rotation of the all the rotating members is stopped may accordingly be reduced by that.

Since the amount of the toner to be newly accumulated is reduced, the amount of the toner disposed on the upper side of the inclination of the "Angle of Repose" determined based on the base point of the border part to the toner containing section on the downstreammost side, the tube-like feeding path, and the development device may also be reduced.

Therefore, it may become possible to prevent a larger amount of toner having excessively increased flowability from being fallen (fed) into the tube-like feeding path and the development device from the toner containing section on the downstreammost side even after the rotation of all the rotating members in the toner storage section and the tube-like feeding path is stopped as occurred in the conventional configuration and the configuration where the upper end portion (upper surface) of dividing part is lower (not sufficiently high).

As a result, it may become possible to stably supply toner to the development device while preventing (reducing) the initial flow and the continual flow.

Further, by having the simple configuration of the dividing part higher than the rotational center of the rotating member of the toner containing section on the upstream side in the toner feeding direction as described above so that the toner can be sequentially fed to the toner containing section on the downstream side by the rotation of the rotating member, it may become possible to reduce the amount of toner to be fallen at a time and sequentially feed the toner by the rotation of the rotating member.

According to an aspect of the present invention, it may become possible to provide a toner supply device that stably supplies toner to the development device while preventing (reducing) the initial flow and the continual flow.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner supply device comprising:

a toner storage section configured to temporarily store toner supplied from a toner container and supply the toner to a development device visualizing a latent image as a toner image, the latent image being formed on a latent image carrier, wherein the toner storage section includes plural toner containing sections arranged from an upstream side to a downstream side in a toner feeding direction and including respective rotating members configured to rotate to feed the toner, wherein a position of a rotational center of the rotating member included in the toner containing section on the downstream side in the toner feeding direction is higher than a position of the rotational center of the rotating member included in the toner containing section on the upstream side in the toner feeding direction, wherein the rotating member of the toner containing section other than the toner containing section disposed on a downstreammost side in the toner feeding direction includes a plate-like elastic member configured to rotate to feed the toner to an adjoining toner containing section disposed on the downstream side in the toner feeding direction, wherein the toner storage section further includes a dividing part formed between the toner containing sections adjacent to each other and including an upper end part and side wall surfaces extended from arc-shaped bottom parts of the respective toner containing sections adjacent to each other so as to form an opening above the dividing part so that the toner can cross over the dividing part and feed from one of the toner containing sections to another via the opening, wherein a position of the upper end part of the dividing part is higher than the position of the rotational center of the rotating member included in the toner containing section on the upstream side in the toner feeding direction of the toner containing sections adjacent to each other, and wherein the toner supplied to the toner containing section disposed on an upstreammost side in the toner feeding direction is sequentially fed to the toner containing section on the downstream side in the toner feeding direction by a rotation of the rotating member including the plate-like elastic member.

2. The toner supply device according to claim 1, wherein the position of the upper end part of the dividing part is higher than the position of the rotational center of the rotating member included in the toner containing section on the downstream side in the toner feeding direction of the toner containing sections adjacent to each other.

3. The toner supply device according to claim 1, wherein a length between an edge portion of the plate-like elastic member on a side opposite to a side of the rotational center of the rotating member including the plate-like elastic member and the rotational center of the rotating member is longer than a length between the rotational center of the rotating member and the upper end part of the dividing part on the downstream side of the toner feeding direction by the rotating member when the plate-like elastic member is not deformed.

4. The toner supply device according to claim 1, wherein the toner storage section further includes a piezoelectric sensor provided on a wall surface of the toner containing section disposed on the upstreammost side in the toner feeding direction and configured to detect an amount of toner contained in the toner containing section and wherein a position of a center height of a detection surface of the piezoelectric sensor is higher than a position of the upper end part of the dividing part formed between the toner containing sections adjacent each other including the toner containing section having the wall surface on which the piezoelectric sensor is provided and the toner containing section disposed on the downstream side of the toner containing section having the wall surface on which the piezoelectric sensor is provided in the toner feeding direction.

5. The toner supply device according to claim 1, wherein the rotating member of the toner containing section disposed on the downstreammost side in the toner feeding direction includes a spiral screw.

6. The toner supply device according to claim 1, wherein the rotating member of the toner containing section disposed on the downstreammost side in the toner feeding direction includes a spiral coil configured to rotate to feed the toner in a toner feeding path to feed the toner to the development device.

7. An image forming apparatus comprising:

the toner supply device according to claim 1.

8. A toner supply device comprising:

a toner storage section to temporarily store toner supplied from a toner container and supply the toner to a development device visualizing a latent image as a toner image, the latent image being formed on a latent image carrier, wherein the toner storage section includes plural toner containing sections arranged from an upstream side to a downstream side in a toner feeding direction and including respective rotating members to rotate to feed the toner, wherein a position of a rotational center of the rotating member included in the toner containing section on the downstream side in the toner feeding direction is higher than a position of the rotational center of the rotating member included in the toner containing section on the upstream side in the toner feeding direction, wherein the toner storage section further includes a dividing part formed between the toner containing sections adjacent to each other and including an upper end part adjacent to each other so as to form an opening above the dividing part, and wherein a position of the upper end part of the dividing part is higher than the position of the rotational center of the rotating member included in the toner containing section on the upstream side in the toner feeding direction of the toner containing sections adjacent to each other.

9. The toner supply device according to claim 8, wherein the position of the upper end part of the dividing part is higher than the position of the rotational center of the rotating member included in the toner containing section on the downstream side in the toner feeding direction of the toner containing sections adjacent to each other.

10. The toner supply device according to claim 8, wherein:

the rotating member includes a plate-like elastic member, and a length between an edge portion of the plate-like elastic member on a side opposite to a side of the rotational center of the rotating member including the plate-like elastic member and the rotational center of the rotating member is longer than a length between the rotational center of the rotating member and the upper end part of the dividing part on the downstream side of the toner feeding direction by the rotating member when the plate-like elastic member is not deformed.

11. The toner supply device according to claim 8, wherein the toner storage section further includes a piezoelectric sensor provided on a wall surface of the toner containing section disposed on an upstreammost side in the toner feeding direction and to detect an amount of toner contained in the toner containing section and wherein a position of a center height of a detection surface of the piezoelectric sensor is higher than a position of the upper end part of the dividing part formed between the toner containing sections adjacent each other including the toner containing section having the wall surface on which the piezoelectric sensor is provided and the toner containing section disposed on the downstream side of the toner containing section having the wall surface on which the piezoelectric sensor is provided in the toner feeding direction.

12. The toner supply device according to claim 8, wherein the rotating member of the toner containing section disposed on a downstreammost side in the toner feeding direction includes a spiral screw.

13. The toner supply device according to claim 8, wherein the rotating member of the toner containing section disposed on a downstreammost side in the toner feeding direction includes a spiral coil to rotate to feed the toner in a toner feeding path to feed the toner to the development device.

14. An image forming apparatus comprising:
the toner supply device according to claim 8.

* * * * *